United States Patent [19]

Wieloch et al.

[11] Patent Number: 4,780,385

[45] Date of Patent: Oct. 25, 1988

[54] ELECTROPHOTOGRAPHIC IMAGING MEMBER CONTAINING ZIRCONIUM IN BASE LAYER

[75] Inventors: Francis J. Wieloch, Penfield; Charles C. Robinson, Fairport; Frederick D. Gonyea, West Henrietta; Harvey S. Towers, Rochester; Anthony M. Horgan, Pittsford; Edward F. Grabowski, Webster; Satish Parikh, Rochester, all of N.Y.

[73] Assignee: Xerox Corporation, Stamford, Conn.

[21] Appl. No.: 41,014

[22] Filed: Apr. 21, 1987

[51] Int. Cl.[4] ..... G03G 5/10

[52] U.S. Cl. ..... 430/58; 430/59; 430/64; 430/69

[58] Field of Search ..... 430/58, 64, 69, 59

[56] References Cited

U.S. PATENT DOCUMENTS

| | | | |
|---|---|---|---|
| 4,232,103 | 11/1980 | Limburg et al. | 430/58 X |
| 4,405,702 | 9/1983 | Shirai et al. . | |
| 4,439,507 | 3/1984 | Pan et al. | 430/59 |
| 4,461,819 | 7/1984 | Nakagawa et al. | 430/59 |
| 4,464,450 | 8/1984 | Teuscher et al. | 430/59 |
| 4,582,772 | 4/1986 | Teuscher et al. | 430/58 |
| 4,587,189 | 5/1986 | Ah-Mee Hor et al. | 430/59 |
| 4,588,667 | 5/1986 | Jones et al. | 430/73 |

FOREIGN PATENT DOCUMENTS

| | | |
|---|---|---|
| 56-024356 | 3/1981 | Japan . |
| 59-212844 | 12/1983 | Japan . |

*Primary Examiner*—J. David Welsh

*Attorney, Agent, or Firm*—Peter H. Kondo

[57] ABSTRACT

An electrophotographic imaging member is disclosed having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

21 Claims, 3 Drawing Sheets

TRANSMISSION vs CYCLING
100% Zr
30 Ti / 70 Zr
50 Zr / 50 Ti
70 Ti / 30 Zr
100% Ti
% TRANSMISSION
70
60
50
40
30
20
10
CYCLE ( x 1000)
0
98
187
276
365
454
543
632
721
810
899
1008
1117
1226
1335
1444
1553
1662
1771
1880
1989
2098
2207
2316
2425
2534
2643
2752
2861
2970
3079
3188
3297
3406
3515
3624
3733
3842
3951
4060
4169
4278
4387
4496
4605
4714
4823
4932
5041
5150
5259
5368
5477
5586
5695
5804
5913
6022
6131
6240
6349
6458
6567
6676
6785
6894
7003
7112
7221
7330
7439
7548
7657
7766
7875
7984
8093
8202
8311
8420
8529
8638
8747
8856
8965
9074
9183
9292
9401
9510
9619
9728
9837
9946
10055
10164
10273
10382
10491
10600
10709
10818
10927
11036
11145
11254
11363
11472
11581
11690
11799
11908
12017
12126
12235
12344
12453
12562
12671
12780
12889
12998
13107
13216
13325
13434
13543
13652
13761
13870
13979
14088
14197
14306
14415
14524
14633
14742
14851
14960
15069
15178
15287
15396
15505
15614
15723
15832
15941
16050
16159
16268
16377
16486
16595
16704
16813
16922
17031
17140
17249
17358
17467
17576
17685
17794
17903
18012
18121
18230
18339
18448
18557
18666
18775
18884
18993
19102
19211
19320
19429
19538
19647
19756
19865
19974
20083
20192
20301
20410
20519
20628
20737
20846
20955
21064
21173
21282
21391
21500
21609
21718
21827
21936
22045
22154
22263
22372
22481
22590
22699
22808
22917
23026
23135
23244
23353
23462
23571
23680
23789
23898
23907
24016
24125
24234
24343
24452
24561
24670
24779
24888
24997
25106
25215
25324
25433
25542
25651
25760
25869
25978
26087
26196
26305
26414
26523
26632
26741
26850
26959
27068
27177
27286
27395
27504
27613
27722
27831
27940
28049
28158
28267
28376
28485
28594
28703
28812
28921
29030
29139
29248
29357
29466
29575
29684
29793
29902
30011
30120
30229
30338
30447
30556
30665
30774
30883
30992
31101
31210
31319
31428
31537
31646
31755
31864
31973
32082
32191
32300
32409
32518
32627
32736
32845
32954
33063
33172
33281
33390
33499
33608
33717
33826
33935
34044
34153
34262
34371
34480
34589
34698
34807
34916
35025
35134
35243
35352
35461
35570
35679
35788
35897
36006
36115
36224
36333
36442
36551
36660
36769
36878
36987
37096
37205
37314
37423
37532
37641
37750
37859
37968
38077
38186
38295
38404
38513
38622
38731
38840
38949
39058
39167
39276
39385
39494
39603
39712
39821
39930
40039
40148
40257
40366
40475
40584
40693
40802
40911
41020
41129
41238
41347
41456
41565
41674
41783
41892
41901
42010
42119
42228
42337
42446
42555
42664
42773
42882
42991
43100
43209
43318
43427
43536
43645
43754
43863
43972
44081
44190
44299
44408
44517
44626
44735
44844
44953
45062
45171
45280
45389
45498
45607
45716
45825
45934
46043
46152
46261
46370
46479
46588
46697
46806
46915
47024
47133
47242
47351
47460
47569
47678
47787
47896
47905
48014
48123
48232
48341
48450
48559
48668
48777
48886
48995
49104
49213
49322
49431
49540
49649
49758
49867
49976
50085
50194
50303
50412
50521
50630
50739
50848
50957
51066
51175
51284
51393
51502
51611
51720
51829
51938
52047
52156
52265
52374
52483
52592
52701
52810
52919
53028
53137
53246
53355
53464
53573
53682
53791
53900
53909
54018
54127
54236
54345
54454
54563
54672
54781
54890
54999
55108
55217
55326
55435
55544
55653
55762
55871
55980
56089
56198
56307
56416
56525
56634
56743
56852
56961
57070
57179
57288
57397
57506
57615
57724
57833
57942
58051
58160
58269
58378
58487
58596
58705
58814
58923
59032
59141
59250
59359
59468
59577
59686
59795
59904
60013
60122
60231
60340
60449
60558
60667
60776
60885
60994
61103
61212
61321
61430
61539
61648
61757
61866
61975
62084
62193
62302
62411
62520
62629
62738
62847
62956
63065
63174
63283
63392
63501
63610
63719
63828
63937
64046
64155
64264
64373
64482
64591
64700
64809
64918
65027
65136
65245
65354
65463
65572
65681
65790
65899
66008
66117
66226
66335
66444
66553
66662
66771
66880
66989
67098
67207
67316
67425
67534
67643
67752
67861
67970
68079
68188
68297
68406
68515
68624
68733
68842
68951
69060
69169
69278
69387
69496
69605
69714
69823
69932
70041
70150
70259
70368
70477
70586
70695
70804
70913
71022
71131
71240
71349
71458
71567
71676
71785
71894
71903
72012
72121
72230
72339
72448
72557
72666
72775
72884
72993
73102
73211
73320
73429
73538
73647
73756
73865
73974
74083
74192
74301
74410
74519
74628
74737
74846
74955
75064
75173
75282
75391
75500
75609
75718
75827
75936
76045
76154
76263
76372
76481
76590
76699
76808
76917
77026
77135
77244
77353
77462
77571
77680
77789
77898
77907
78016
78125
78234
78343
78452
78561
78670
78779
78888
78997
79106
79215
79324
79433
79542
79651
79760
79869
79978
80087
80196
80305
80414
80523
80632
80741
80850
80959
81068
81177
81286
81395
81504
81613
81722
81831
81940
82049
82158
82267
82376
82485
82594
82703
82812
82921
83030
83139
83248
83357
83466
83575
83684
83793
83902
83911
84020
84129
84238
84347
84456
84565
84674
84783
84892
85001
85110
85219
85328
85437
85546
85655
85764
85873
85982
86091
86200
86309
86418
86527
86636
86745
86854
86963
87072
87181
87290
87399
87508
87617
87726
87835
87944
88053
88162
88271
88380
88489
88598
88707
88816
88925
89034
89143
89252
89361
89470
89579
89688
89797
89906
89915
90024
90133
90242
90351
90460
90569
90678
90787
90896
91005
91114
91223
91332
91441
91550
91659
91768
91877
91986
92095
92204
92313
92422
92531
92640
92749
92858
92967
93076
93185
93294
93403
93512
93621
93730
93839
93948
94057
94166
94275
94384
94493
94602
94711
94820
94929
95038
95147
95256
95365
95474
95583
95692
95801
95910
96019
96128
96237
96346
96455
96564
96673
96782
96891
96900
97009
97118
97227
97336
97445
97554
97663
97772
97881
97990
98099
98208
98317
98426
98535
98644
98753
98862
98971
99080
99189
99298
99407
99516
99625
99734
99843
99952
100061
100170
100279
100388
100497
100606
100715
100824
100933
101042
101151
101260
101369
101478
101587
101696
101805
101914
102023
102132
102241
102350
102459
102568
102677
102786
102895
102904
103013
103122
103231
103340
103449
103558
103667
103776
103885
103994
104103
104212
104321
104430
104539
104648
104757
104866
104975
105084
105193
105302
105411
105520
105629
105738
105847
105956
106065
106174
106283
106392
106501
106610
106719
106828
106937
107046
107155
107264
107373
107482
107591
107700
107809
107918
108027
108136
108245
108354
108463
108572
108681
108790
108899
109008
109117
109226
109335
109444
109553
109662
109771
109880
109989
110098
110207
110316
110425
110534
110643
110752
110861
110970
111079
111188
111297
111406
111515
111624
111733
111842
111951
112060
112169
112278
112387
112496
112605
112714
112823
112932
113041
113150
113259
113368
113477
113586
113695
113804
113913
114022
114131
114240
114349
114458
114567
114676
114785
114894
115003
115112
115221
115330
115439
115548
115657
115766
115875
115984
116093
116202
116311
116420
116529
116638
116747
116856
116965
117074
117183
117292
117401
117510
117619
117728
117837
117946
118055
118164
118273
118382
118491
118600
118709
118818
118927
119036
119145
119254
119363
119472
119581
119690
119799
119908
119917
120026
120135
120244
120353
120462
120571
120680
120789
120898
121007
121116
121225
121334
121443
121552
121661
121770
121879
121988
122097
122206
122315
122424
122533
122642
122751
122860
122969
123078
123187
123296
123405
123514
123623
123732
123841
123950
124059
124168
124277
124386
124495
124604
124713
124822
124931
125040
125149
125258
125367
125476
125585
125694
125803
125912
126021
126130
126239
126348
126457
126566
126675
126784
126893
127002
127111
127220
127329
127438
127547
127656
127765
127874
127983
128092
128201
128310
128419
128528
128637
128746
128855
128964
129073
129182
129291
129400
129509
129618
129727
129836
129945
130054
130163
130272
130381
130490
130599
130708
130817
130926
131035
131144
131253
131362
131471
131580
131689
131798
131907
132016
132125
132234
132343
132452
132561
132670
132779
132888
132997
133106
133215
133324
133433
133542
133651
133760
133869
133978
134087
134196
134305
134414
134523
134632
134741
134850
134959
135068
135177
135286
135395
135504
135613
135722
135831
135940
136049
136158
136267
136376
136485
136594
136703
136812
136921
137030
137139
137248
137357
137466
137575
137684
137793
137902
137911
138020
138129
138238
138347
138456
138565
138674
138783
138892
139001
139110
139219
139328
139437
139546
139655
139764
139873
139982
140091
140200
140309
140418
140527
140636
140745
140854
140963
141072
141181
141290
141399
141508
141617
141726
141835
141944
142053
142162
142271
142380
142489
142598
142707
142816
142925
143034
143143
143252
143361
143470
143579
143688
143797
143906
143915
144024
144133
144242
144351
144460
144569
144678
144787
144896
145005
145114
145223
145332
145441
145550
145659
145768
145877
145986
146095
146204
146313
146422
146531
146640
146749
146858
146967
147076
147185
147294
147403
147512
147621
147730
147839
147948
148057
148166
148275
148384
148493
148602
148711
148820
148929
149038
149147
149256
149365
149474
149583
149692
149801
149910
149919
150028
150137
150246
150355
150464
150573
150682
150791
150900
151009
151118
151227
151336
151445
151554
151663
151772
151881
151990
152099
152208
152317
152426
152535
152644
152753
152862
152971
153080
153189
153298
153407
153516
153625
153734
153843
153952
154061
154170
154279
154388
154497
154606
154715
154824
154933
155042
155151
155260
155369
155478
155587
155696
155805
155914
156023
156132
156241
156350
156459
156568
156677
156786
156895
156904
157013
157122
157231
157340
157449
157558
157667
157776
157885
157994
158103
158212
158321
158430
158539
158648
158757
158866
158975
159084
159193
159302
159411
159520
159629
159738
159847
159956
160065
160174
160283
160392
160501
160610
160719
160828
160937
161046
161155
161264
161373
161482
161591
161700
161809
161918
162027
162136
162245
162354
162463
162572
162681
162790
162899
162908
163017
163126
163235
163344
163453
163562
163671
163780
163889
163998
164107
164216
164325
164434
164543
164652
164761
164870
164979
165088
165197
165306
165415
165524
165633
165742
165851
165960
166069
166178
166287
166396
166505
166614
166723
166832
166941
167050
167159
167268
167377
167486
167595
167704
167813
167922
168031
168140
168249
168358
168467
168576
168685
168794
168903
169012
169121
169230
169339
169448
169557
169666
169775
169884
169993
170102
170211
170320
170429
170538
170647
170756
170865
170974
171083
171192
171301
171410
171519
171628
171737
171846
171955
172064
172173
172282
172391
172500
172609
172718
172827
172936
173045
173154
173263
173372
173481
173590
173699
173808
173917
174026
174135
174244
174353
174462
174571
174680
174789
174898
174907
175016
175125
175234
175343
175452
175561
175670
175779
175888
175997
176106
176215
176324
176433
176542
176651
176760
176869
176978
177087
177196
177305
177414
177523
177632
177741
177850
177959
178068
178177
178286
178395
178504
178613
178722
178831
178940
179049
179158
179267
179376
179485
179594
179703
179812
179921
180030
180139
180248
180357
180466
180575
180684
180793
180902
181011
181120
181229
181338
181447
181556
181665
181774
181883
181992
182101
182210
182319
182428
182537
182646
182755
182864
182973
183082
183191
183300
183409
183518
183627
183736
183845
183954
184063
184172
184281
184390
184499
184608
184717
184826
184935
185044
185153
185262
185371
185480
185589
185698
185807
185916
186025
186134
186243
186352
186461
186570
186679
186788
186897
186906
187015
187124
187233
187342
187451
187560
187669
187778
187887
187996
188105
188214
188323
188432
188541
188650
188759
188868
188977
189086
189195
189304
189413
189522
189631
189740
189849
189958
190067
190176
190285
190394
190503
190612
190721
190830
190939
191048
191157
191266
191375
191484
191593
191702
191811
191920
192029
192138
192247
192356
192465
192574
192683
192792
192901
192910
193019
193128
193237
193346
193455
193564
193673
193782
193891
194000
194109
194218
194327
194436
194545
194654
194763
194872
194981
195090
195199
195308
195417
195526
195635
195744
195853
195962
196071
196180
196289
196398
196507
196616
196725
196834
196943
197052
197161
197270
197379
197488
197597
197706
197815
197924
198033
198142
198251
198360
198469
198578
198687
198796
198905
198914
199023
199132
199241
199350
199459
199568
199677
199786
199895
200004
200113
200222
200331
200440
200549
200658
200767
200876
200985
201094
201203
201312
201421
201530
201639
201748
201857
201966
202075
202184
202293
202402
202511
202620
202729
202838
202947
203056
203165
203274
203383
203492
203601
203710
203819
203928
203937
204046
204155
204264
204373
204482
204591
204700
204809
204918
205027
205136
205245
205354
205463
205572
205681
205790
205899
206008
206117
206226
206335
206444
206553
206662
206771
206880
206989
207098
207207
207316
207425
207534
207643
207752
207861
207970
208079
208188
208297
208406
208515
208624
208733
208842
208951
209060
209169
209278
209387
209496
209605
209714
209823
209932
210041
210150
210259
210368
210477
210586
210695
210804
210913
211022
211131
211240
211349
211458
211567
211676
211785
211894
211903
212012
212121
212230
212339
212448
212557
212666
212775
212884
212993
213102
213211
213320
213429
213538
213647
213756
213865
213974
214083
214192
214301
214410
214519
214628
214737
214846
214955
215064
215173
215282
215391
215500
215609
215718
215827
215936
216045
216154
216263
216372
216481
216590
216699
216808
216917
217026
217135
217244
217353
217462
217571
217680
217789
217898
217907
218016
218125
218234
218343
218452
218561
218670
218779
218888
218997
219106
219215
219324
219433
219542
219651
219760
219869
219978
220087
220196
220305
220414
220523
220632
220741
220850
220959
221068
221177
221286
221395
221504
221613
221722
221831
221940
222049
222158
222267
222376
222485
222594
222703
222812
222921
223030
223139
223248
223357
223466
223575
223684
223793
223902
223911
224020
224129
224238
224347
224456
224565
224674
224783
224892
225001
225110
225219
225328
225437
225546
225655
225764
225873
225982
226091
226200
226309
226418
226527
226636
226745
226854
226963
227072
227181
227290
227399
227508
227617
227726
227835
227944
228053
228162
228271
228380
228489
228598
228707
228816
228925
229034
229143
229252
229361
229470
229579
229688
229797
229906
229915
230024
230133
230242
230351
230460
230569
230678
230787
230896
231005
231114
231223
231332
231441
231550
231659
231768
231877
231986
232095
232204
232313
232422
232531
232640
232749
232858
232967
233076
233185
233294
233403
233512
233621
233730
233839
233948
234057
234166
234275
234384
234493
234602
234711
234820
234929
235038
235147
235256
235365
235474
235583
235692
235801
235910
236019
236128
236237
236346
236455
236564
236673
236782
236891
236900
237009
237118
237227
237336
237445
237554
237663
237772
237881
237990
238099
238208
238317
238426
238535
238644
238753
238862
238971
239080
239189
239298
239407
239516
239625
239734
239843
239952
240061
240170
240279
240388
240497
240606
240715
240824
240933
241042
241151
241260
241369
241478
241587
241696
241805
241914
242023
242132
242241
242350
242459
242568
242677
242786
242895
242904
243013
243122
243231
243340
243449
243558
243667
243776
243885
243994
244103
244212
244321
244430
244539
244648
244757
244866
244975
245084
245193
245302
245411
245520
245629
245738
245847
245956
246065
246174
246283
246392
246501
246610
246719
246828
246937
247046
247155
247264
247373
247482
247591
247700
247809
247918
248027
248136
248245
248354
248463
248572
248681
248790
248899
248908
249017
249126
249235
249344
249453
249562
249671
249780
249889
249998
250107
250216
250325
250434
250543
250652
250761
250870
250979
251088
251197
251306
251415
251524
251633
251742
251851
251960
252069
252178
252287
252396
252505
252614
252723
252832
252941
253050
253159
253268
253377
253486
253595
253704
253813
253922
253931
254040
254149
254258
254367
254476
254585
254694
254803
254912
255021
255130
255239
255348
255457
255566
255675
255784
255893
256002
256111
256220
256329
256438
256547
256656
256765
256874
256983
257092
257201
257310
257419
257528
257637
257746
257855
257964
258073
258182
258291
258400
258509
258618
258727
258836
258945
259054
259163
259272
259381
259490
259599
259708
259817
259926
259935
260044
260153
260262
260371
260480
260589
260698
260807
260916
261025
261134
261243
261352
261461
261570
261679
261788
261897
262006
262115
262224
262333
262442
262551
262660
262769
262878
262987
263096
263205
263314
263423
263532
263641
263750
263859
263968
264077
264186
264295
264404
264513
264622
264731
264840
264949
265058
265167
265276
265385
265494
265603
265712
265821
265930
266039
266148
266257
266366
266475
266584
266693
266802
266911
266920
267029
267138
267247
267356
267465
267574
267683
267792
267901
268010
268119
268228
268337
268446
268555
268664
268773
268882
268991
269100
269209
269318
269427
269536
269645
269754
269863
269972
270081
270190
270299
270408
270517
270626
270735
270844
270953
271062
271171
271280
271389
271498
271607
271716
271825
271934
272043
272152
272261
272370
272479
272588
272697
272806
272915
272924
273033
273142
273251
273360
273469
273578
273687
273796
273905
274014
274123
274232
274341
274450
274559
274668
274777
274886
274995
275104
275213
275322
275431
275540
275649
275758
275867
275976
276085
276194
276303
276412
276521
276630
276739
276848
276957
277066
277175
277284
277393
277502
277611
277720
277829
277938
277947
278056
278165
278274
278383
278492
278601
278710
278819
278928
279037
279146
279255
279364
279473
279582
279691
279800
279909
280018
280127
280236
280345
280454
280563
280672
280781
280890
280999
281108
281217
281326
281435
281544
281653
281762
281871
281980
281989
282098
282207
282316
282425
282534
282643
282752
282861
282970
283079
283188
283297
283406
283515
283624
283733
283842
283951
284060
284169
284278
284387
284496
284605
284714
284823
284932
285041
285150
285259
285368
285477
285586
285695
285804
285913
286022
286131
286240
286349
286458
286567
286676
286785
286894
286903
287012
287121
287230
287339
287448
287557
287666
287775
287884
287993
288102
288211
288320
288429
288538
288647
288756
288865
288974
289083
289192
289301
289410
289519
289628
289737
289846
289955
290064
290173
290282
290391
290500
290609
290718
290827
290936
291045
291154
291263
291372
291481
291590
291699
291808
291917
292026
292135
292244
292353
292462
292571
292680
292789
292898
292907
293016
293125
293234
293343
293452
293561
293670
293779
293888
293997
294106
294215
294324
294433
294542
294651
294760
294869
294978
295087
295196
295305
295414
295523
295632
295741
295850
295959
296068
296177
296286
296395
296504
296613
296722
296831
296940
297049
297158
297267
297376
297485
297594
297703
297812
297921
297930
298039
298148
298257
298366
298475
298584
298693
298802
298911
299020
299129
299238
299347
299456
299565
299674
299783
299892
299901
300010
300119
300228
300337
300446
300555
300664
300773
300882
300991
301100
301209
301318
301427
301536
301645
301754
301863
301972
302081
302190
302299
302408
302517
302626
302735
302844
302953
303062
303171
303280
303389
303498
303607
303716
303825
303934
304043
304152
304261
304370
304479
304588
304697
304806
304915
305024
305133
305242
305351
305460
305569
305678
305787
305896
305905
306014
306123
306232
306341
306450
306559
306668
306777
306886
306995
307104
307213
307322
307431
307540
307649
307758
307867
307976
308085
308194
308303
308412
308521
308630
308739
308848
308957
309066
309175
309284
309393
309502
309611
309720
309829
309938
309947
310056
310165
310274
310383
310492
310601
310710
310819
310928
311037
311146
311255
311364
311473
311582
311691
311800
311909
312018
312127
312236
312345
312454
312563
312672
312781
312890
312999
313108
313217
313326
313435
313544
313653
313762
313871
313980
314089
314198
314307
314416
314525
314634
314743
314852
314961
315070
315179
315288
315397
315506
315615
315724
315833
315942
316051
316160
316269
316378
316487
316596
316705
316814
316923
316932
317041
317150
317259
317368
317477
317586
317695
317804
317913
318022
318131
318240
318349
318458
318567
318676
318785
318894
319003
319112
319221
319330
319439
319548
319657
319766
319875
319984
320093
320202
320311
320420
320529
320638
320747
320856
320965
321074
321183
321292
321401
321510
321619
321728
321837
321946
322055
322164
322273
322382
322491
322600
322709
322818
322927
322936
323045
323154
323263
323372
323481
323590
323699
323808
323917
324026
324135
324244
324353
324462
324571
324680
324789
324898
325007
325116
325225
325334
325443
325552
325661
325770
325879
325988
326097
326206
326315
326424
326533
326642
326751
326860
326969
327078
327187
327296
327405
327514
327623
327732
327841
327950
328059
328168
328277
328386
328495
328604
328713
328822
328931
328940
329049
329158
329267
329376
329485
329594
329703
329812
329921
330030
330139
330248
330357
330466
330575
330684
330793
330902
331011
331120
331229
331338
331447
331556
331665
331774
331883
331992
332101
332210
332319
332428
332537
332646
332755
332864
332973
333082
333191
333300
333409
333518
333627
333736
333845
333954
334063
334172
334281
334390
334499
334608
334717
334826
334935
335044
335153
335262
335371
335480
335589
335698
335807
335916
336025
336134
336243
336352
336461
336570
336679
336788
336897
336906
337015
337124
337233
337342
337451
337560
337669
337778
337887
337996
338105
338214
338323
338432
338541
338650
338759
338868
338977
339086
339195
339304
339413
339522
339631
339740
339849
339958
340067
340176
340285
340394
340503
340612
340721
340830
340939
341048
341157
341266
341375
341484
341593
341702
341811
341920
342029
342138
342247
342356
342465
342574
342683
342792
342901
342910
343019
343128
343237
343346
343455
343564
343673
343782
343891
344000
344109
344218
344327
344436
344545
344654
344763
344872
344981
345090
345199
345308
345417
345526
345635
345744
345853
345962
346071
346180
346289
346398
346507
346616
346725
346834
346943
347052
347161
347270
347379
347488
347597
347706
347815
347924
348033
348142
348251
348360
348469
348578
348687
348796
348905
348914
349023
349132
349241
349350
349459
349568
349677
349786
349895
350004
350113
350222
350331
350440
350549
350658
350767
350876
350985
351094
351203
351312
351421
351530
351639
351748
351857
351966
352075
352184
352293
352402
352511
352620
352729
352838
352947
353056
353165
353274
353383
353492
353601
353710
353819
353928
353937
354046
354155
354264
354373
354482
354591
354700
354809
354918
355027
355136
355245
355354
355463
355572
355681
355790
355899
356008
356117
356226
356335
356444
356553
356662
356771
356880
356989
357098
357207
357316
357425
357534
357643
357752
357861
357970
358079
358188
358297
358406
358515
358624
358733
358842
358951
359060
359169
359278
359387
359496
359605
359714
359823
359932
359941
360050
360159
360268
360377
360486
360595
360704
360813
360922
361031
361140
361249
361358
361467
361576
361685
361794
361903
362012
362121
362230
362339
362448
362557
362666
362775
362884
362993
363102
363211
363320
363429
363538
363647
363756
363865
363974
364083
364192
364301
364410
364519
364628
364737
364846
364955
365064
365173
365282
365391
365500
365609
365718
365827
365936
366045
366154
366263
366372
366481
366590
366699
366808
366917
367026
367135
367244
367353
367462
367571
367680
367789
367898
367907
368016
368125
368234
368343
368452
368561
368670
368779
368888
368997
369106
369215
369324
369433
369542
369651
369760
369869
369978
370087
370196
370305
370414
370523
370632
370741
370850
370959
371068
371177
371286
371395
371504
371613
371722
371831
371940
372049
372158
372267
372376
372485
372594
372703
372812
372921
372930
373039
373148
373257
373366
373475
373584
373693
373802
373911
374020
374129
374238
374347
374456
374565
374674
374783
374892
375001
375110
375219
375328
375437
375546
375655
375764
375873
375982
376091
376200
376309
376418
376527
376636
376745
376854
376963
377072
377181
377290
377399
377508
377617
377726
377835
377944
378053
378162
378271
378380
378489
378598
378707
378816
378925
378934
379043
379152
379261
379370
379479
379588
379697
379806
379915
380024
380133
380242
380351
380460
380569
380678
380787
380896
381005
381114
381223
381332
381441
381550
381659
381768
381877
381986
382095
382204
382313
382422
382531
382640
382749
382858
382967
383076
383185
383294
383403
383512
383621
383730
383839
383948
384057
384166
384275
384384
384493
384602
384711
384820
384929
385038
385147
385256
385365
385474
385583
385692
385801
385910
386019
386128
386237
386346
386455
386564
386673
386782
386891
386900
387009
387118
387227
387336
387445
387554
387663
387772
387881
387990
388099
388208
388317
388426
388535
388644
388753
388862
388971
389080
389189
389298
389407
389516
389625
389734
389843
389952
390061
390170
390279
390388
390497
390606
390715
390824
390933
391042
391151
391260
391369
391478
391587
391696
391805
391914
392023
392132
392241
392350
392459
392568
392677
392786
392895
392904
393013
393122
393231
393340
393449
393558
393667
393776
393885
393994
394103
394212
394321
394430
394539
394648
394757
394866
394975
395084
395193
395302
395411
395520
395629
395738
395847
395956
396065
396174
396283
396392
396501
396610
396719
396828
396937
397046
397155
397264
397373
397482
397591
397700
397809
397918
398027
398136
398245
398354
398463
398572
398681
398790
398899
398908
399017
399126
399235
399344
399453
399562
399671
399780
399889
399998
400107
400216
400325
400434
400543
400652
400761
400870
400979
401088
401197
401306
401415
401524
401633
401742
401851
401960
402069
402178
402287
402396
402505
402614
402723
402832
402941
403050
403159
403268
403377
403486
403595
403704
403813
403922
403931
404040
404149
404258
404367
404476
404585
404694
404803
404912
405021
405130
405239
405348
405457
405566
405675
405784
405893
406002
406111
406220
406329
406438
406547
406656
406765
406874
406983
407092
407201
407310
407419
407528
407637
407746
407855
407964
408073
408182
408291
408400
408509
408618
408727
408836
408945
409054
409163
409272
409381
409490
409599
409708
409817
409926
410035
410144
410253
410362
410471
410580
410689
410798
410907
410916
411025
411134
411243
411352
411461
411570
411679
411788
411897
412006
412115
412224
412333
412442
412551
412660
412769
412878
412987
413096
413205
413314
413423
413532
413641
413750
413859
413968
414077
414186
414295
414404
414513
414622
414731
414840
414949
415058
415167
415276
415385
415494
415603
415712
415821
415930
416039
416148
416257
416366
416475
416584
416693
416802
416911
416920
417029
417138
417247
417356
417465
417574
417683
417792
417901
418010
418119
418228
418337
418446
418555
418664
418773
418882
418991
419100
419209
419318
419427
419536
419645
419754
419863
419972
420081
420190
420299
420408
420517
420626
420735
420844
420953
421062
421171
421280
421389
421498
421607
421716
421825
421934
422043
422152
422261
422370
422479
422588
422697
422806
422915
422924
423033
423142
423251
423360
423469
423578
423687
423796
423905
424014
424123
424232
424341
424450
424559
424668
424777
424886
424995
425104
425213
425322
425431
425540
425649
425758
425867
425976
426085
426194
426303
426412
426521
426630
426739
426848
426957
427066
427175
427284
427393
427502
427611
427720
427829
427938
427947
428056
428165
428274
428383
428492
428601
428710
428819
428928
429037
429146
429255
429364
429473
429582
429691
429800
429909
430018
430127
430236
430345
430454
430563
430672
430781
430890
430999
431108
431217
431326
431435
431544
431653
431762
431871
431980
431989
432098
432207
432316
432425
432534
432643
432752
432861
432970
433079
433188
433297
433406
433515
433624
433733
433842
433951
434060
434169
434278
434387
434496
434605
434714
434823
434932
435041
435150
435259
435368
435477
435586
435695
435804
435913
436022
436131
436240
436349
436458
436567
436676
436785
436894
436903
437012
437121
437230
437339
437448
437557
437666
437775
437884
437993
438102
438211
438320
438429
438538
438647
438756
438865
438974
439083
439192
439301
439410
439519
439628
439737
439846
439955
440064
440173
440282
440391
440500
440609
440718
440827
440936
441045
441154
441263
441372
441481
441590
441699
441808
441917
442026
442135
442244
442353
442462
442571
442680
442789
442898
442907
443016
443125
443234
443343
443452
443561
443670
443779
443888
443997
444106
444215
444324
444433
444542
444651
444760
444869
444978
445087
445196
445305
445414
445523
445632
445741
445850
445959
446068
446177
446286
446395
446504
446613
446722
446831
446940
447049
447158
447267
447376
447485
447594
447703
447812
447921
447930
448039
448148
448257
448366
448475
448584
448693
448802
448911
449020
449129
449238
449347
449456
449565
449674
449783
449892
449901
450010
450119
450228
450337
450446
450555
450664
450773
450882
450991
451100
451209
451318
451427
451536
451645
451754
451863
451972
452081
452190
452299
452408
452517
452626
452735
452844
452953
453062
453171
453280
453389
453498
453607
453716
453825
453934
454043
454152
454261
454370
454479
454588
454697
454806
454915
455024
455133
455242
455351
455460
455569
455678
455787
455896
455905
456014
456123
456232
456341
456450
456559
456668
456777
456886
456995
457104
457213
457322
457431
457540
457649
457758
457867
457976
458085
458194
458303
458412
458521
458630
458739
458848
458957
459066
459175
459284
459393
459502
459611
459720
459829
459938
459947
460056
460165
460274
460383
460492
460601
460710
460819
460928
461037
461146
461255
461364
461473
461582
461691
461800
461909
462018
462127
462236
462345
462454
462563
462672
462781
462890
462999
463108
463217
463326
463435
463544
463653
463762
463871
463980
464089
464198
464307
464416
464525
464634
464743
464852
464961
465070
465179
465288
465397
465506
465615
465724
465833
465942
466051
466160
466269
466378
466487
466596
466705
466814
466923
466932
467041
467150
467259
467368
467477
467586
467695
467804
467913
468022
468131
468240
468349
468458
468567
468676
468785
468894
469003
469112
469221
469330
469439
469548
469657
469766
469875
469984
470093
470202
470311
470420
470529
470638
470747
470856
470965
471074
471183
471292
471401
471510
471619
471728
471837
471946
472055
472164
472273
472382
472491
472600
472709
472818
472927
472936
473045
473154
473263
473372
473481
473590
473699
473808
473917
474026
474135
474244
474353
474462
474571
474680
474789
474898
475007
475116
475225
475334
475443
475552
475661
475770
475879
475988
476097
476206
476315
476424
476533
476642
476751
476860
476969
477078
477187
477296
477405
477514
477623
477732
477841
477950
478059
478168
478277
478386
478495
478604
478713
478822
478931
478940
479049
479158
479267
479376
479485
479594
479703
479812
479921
480030
480139
480248
480357
480466
480575
480684
480793
480902
481011
481120
481229
481338
481447
481556
481665
481774
481883
481992
482101
482210
482319
482428
482537
482646
482755
482864
482973
483082
483191
483300
483409
483518
483627
483736
483845
483954
484063
484172
484281
484390
484499
484608
484717
484826
484935
485044
485153
485262
485371
485480
485589
485698
485807
485916
486025
486134
486243
486352
486461
486570
486679
486788
486897
486906
487015
487124
487233
487342
487451
487560
487669
487778
487887
487996
488105
488214
488323
488432
488541
488650
488759
488868
488977
489086
489195
489304
489413
489522
489631
489740
489849
489958
490067
490176
490285
490394
490503
490612
490721
490830
490939
491048
491157
491266
491375
491484
491593
491702
491811
491920
492029
492138
492247
492356
492465
492574
492683
492792
492901
492910
493019
493128
493237
493346
493455
493564
493673
493782
493891
494000
494109
494218
494327
494436
494545
494654
494763
494872
494981
495090
495199
495308
495417
495526
495635
495744
495853
495962
496071
496180
496289
496398
496507
496616
496725
496834
496943
497052
497161
497270
497379
497488
497597
497706
497815
497924
498033
498142
498251
498360
498469
498578
498687
498796
498905
498914
499023
499132
499241
499350
499459
499568
499677
499786
499895
500004
500113
500222
500331
500440
500549
500658
500767
500876
500985
501094
501203
501312
501421
501530
501639
501748
501857
501966
502075
502184
502293
502402
502511
502620
502729
502838
502947
503056
503165
503274
503383
503492
503601
503710
503819
503928
503937
504046
504155
504264
504373
504482
504591
504700
504809
504918
505027
505136
505245
505354
505463
505572
505681
505790
505899
506008
506117
506226
506335
506444
506553
506662
506771
506880
506989
507098
507207
507316
507425
507534
507643
507752
507861
507970
508079
508188
508297
508406
508515
508624
508733
508842
508951
509060
509169
509278
509387
509496
509605
509714
509823
509932
509941
510050
510159
510268
510377
510486
510595
510704
510813
510922
511031
511140
511249
511358
511467
511576
511685
511794
511903
512012
512121
512230
512339
512448
512557
512666
512775
512884
512993
513102
513211
513320
513429
513538
513647
513756
513865
513974
514083
514192
514301
514410
514519
514628
514737
514846
514955
515064
515173
515282
515391
515500
515609
515718
515827
515936
516045
516154
516263
516372
516481
516590
516699
516808
516917
517026
517135
517244
517353
517462
517571
517680
517789
517898
517907
518016
518125
518234
518343
518452
518561
518670
518779
518888
518997
519106
519215
519324
519433
519542
519651
519760
519869
519978
520087
520196
520305
520414
520523
520632
520741
520850
520959
521068
521177
521286
521395
521504
521613
521722
521831
521940
522049
522158
522267
522376
522485
522594
522703
522812
522921
523030
523139
523248
523357
523466
523575
523684
523793
523902
523911
524020
524129
524238
524347
524456
524565
524674
524783
524892
525001
525110
525219
525328
525437
525546
525655
525764
525873
525982
526091
526200
526309
526418
526527
526636
526745
526854
526963
527072
527181
527290
527399
527508
527617
527726
527835
527944
528053
528162
528271
528380
528489
528598
528707
528816
528925
529034
529143
529252
529361
529470
529579
529688
529797
529906
529915
530024
530133
530242
530351
530460
530569
530678
530787
530896
531005
531114
531223
531332
531441
531550
531659
531768
531877
531986
532095
532204
532313
532422
532531
532640
532749
532858
532967
533076
533185
533294
533403
533512
533621
533730
533839
533948
534057
534166
534275
534384
534493
534602
534711
534820
534929
535038
535147
535256
535365
535474
535583
535692
535801
535910
536019
536128
536237
536346
536455
536564
536673
536782
536891
536900
537009
537118
537227
537336
537445
537554
537663
537772
537881
537990
538099
538208
538317
538426
538535
538644
538753
538862
538971
539080
539189
539298
539407
539516
539625
539734
539843
539952
540061
540170
540279
540388
540497
540606
540715
540824
540933
541042
541151
541260
541369
541478
541587
541696
541805
541914
542023
542132
542241
542350
542459
542568
542677
542786
542895
542904
543013
543122
543231
543340
543449
543558
543667
543776
543885
543994
544103
544212
544321
544430
544539
544648
544757
544866
544975
545084
545193
545302
545411
545520
545629
545738
545847
545956
546065
546174
546283
546392
546501
546610
546719
546828
546937
547046
547155
547264
547373
547482
547591
547700
547809
547918
547907
548016
548125
548234
548343
548452
548561
548670
548779
548888
548997
549106
549215
549324
549433
549542
549651
549760
549869
549978
550087
550196
550305
550414
550523
550632
550741
550850
550959
551068
551177
551286
551395
551504
551613
551722
551831
551940
552049
552158
552267
552376
552485
552594
552703
552812
552921
553030
553139
553248
553357
553466
553575
553684
553793
553902
553911
554020
554129
554238
554347
554456
554565
554674
554783
554892
555001
555110
555219
555328
555437
555546
555655
555764
555873
555982
556091
556200
556309
556418
556527
556636
556745
556854
556963
557072
557181
557290
557399
557508
557617
557726
557835
557944
558053
558162
558271
558380
558489
558598
558707
558816
558925
559034
559143
559252
559361
559470
559579
559688
559797
559906
559915
560024
560133
560242
560351
560460
560569
560678
560787
560896
561005
561114
561223
561332
561441
561550
561659
561768
561877
561986
562095
562204
562313
562422
562531
562640
562749
562858
562967
563076
563185
563294
563403
563512
563621
563730
563839
563948
564057
564166
564275
564384
564493
564602
564

ELECTROPHOTOGRAPHIC IMAGING MEMBER CONTAINING ZIRCONIUM IN BASE LAYER

BACKGROUND OF THE INVENTION

This invention relates in general to electrophotography and more specifically, to an electrophotographic imaging member and process for using the imaging member.

In the art of electrophotography an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the ground plane of many modern photoconductive imaging members must be highly flexible, adhere well to flexible supporting substrates, and exhibit predictable electrical characteristics within narrow operating limits to provide excellent toner images over many thousands of cycles.

One type of ground plane which is gaining increasing popularity for belt type photoreceptors in vacuum deposited aluminum coated with two electrically operative layers, including a charge generating layer and a charge transport layer. However, aluminum films are relatively soft and exhibit poor scratch resistance during photoreceptor fabrication processing. In addition, vacuum deposited aluminum exhibits poor optical transmission stability after extended cycling in xerographic imaging systems. This poor optical transmission stability is the result of oxidation of the aluminum ground plane as electric current is passed across the junction between the metal and photoreceptor. The optical transmission degradation is continuous and, for systems utilizing erase lamps on the nonimaging side of the photoconductive web, has necessitated erase intensity adjustment every 20,000 copies over the life of the photoreceptor.

Further, the electrical cyclic stability of an aluminum ground plane in multilayer structured photoreceptors has been found to be unstable when cycled thousands of times. The oxidies of aluminum which naturally form on the aluminum metal employed as an electrical blocking layer prevent charge injection during charging of the photoconductive device. If the resistivity of this blocking layer becomes too great, a residual potential will build across the layer as the device is cycled. Since the thickness of the oxide layer on an aluminum ground plane is not stable, the electrical performance characteristics of a composite photoreceptor undergoes changes during electrophotographic cycling. Also, the storage life of many composite photoreceptors utilizing an aluminum ground plane can be as brief as one day at high temperatures and humidity due to accelerated oxidation of the metal. The accelerated oxidation of the metal ground plane increases optical transmission, causes copy quality nonuniformity and can ultimately result in loss of electrical grounding capability.

After long-term use in an electrophotographic copying machine, multilayered photoreceptors utilizing the aluminum ground plane have been observed to exhibit a dramatic dark development potential change between the first cycle and second cycle of the machine due to cyclic instability, referred to as "cycle 1 to 2 dark development potential variation". The magnitude of this effects is dependent upon cyclic age and relatively humidity but may be as large as 350 volts after 50,000 electrical cycles. This effect is related to interaction of the ground plane and photoconductive materials. Another serious effect of the aluminum ground plane is the loss of image potential with cycling at low relative humidity. This cycle down voltage is most severe at relative humidities below about 10 percent. With continued cycling, the image potential decreases to a degree where the photoreceptor cannot provide a satisfactory image in the low humidity atmosphere.

In Japanese Patent Publication No. J5 6024-356 to Fuji Photo Film KK, published Mar. 7, 1981, an electrophotographic photoreceptor is described comprising a conductive support, an inorganic amorphous silicon photosensitive layer which produces a charge carrier by photo-irradiation, and a charge blocking layer between the conductive support and the inorganic amorphous silicon photosensitive layer, the charge blocking layer forming a barrier against electric charge carriers. The charge blocking layer comprises an insulating or semiconductive material such as $SiO_2$, $Al_2O_3$, $ZrO_2$, $TiO_2$ or an organic polymer such as polycarbonate, polyvinylbutyral, etc. These charge blocking layer materials are intended to block electrons into the inorganic amorphous silicon photosensitive layer. Although not disclosed in this Japanese Patent Publication, it should be noted that charge blocking layer materials suitable for blocking electrons into an inorganic amorphous silicon photosensitive layer may not necessarily be suitable for blocking holes into an organic hole generator layer. To be operable, these blocking layers must not block holes from the positively charged inorganic amorphous silicon photosensitive layer to the conductive support. For example, an $Al_2O_3$ film having a thickness of several hundred angstroms utilized as a blocking layer caused dark development potential cycle down, with accompanying dark decay, of a negatively charged multilayer structured photoreceptor comprising conductive ground plane, blocking layer, charge generating layer and a hole transport layer.

In some multilayered photoreceptors, the ground plane is titanium coated on a polyester film. The titanium coating is sputtered on the polyester film in a layer about 175 angstroms thick. The titanium layer acts as a conductive path for electrons during the exposure step in the photoconductive process and overcomes many of the problems presented by aluminum ground planes. Photoreceptors containing titanium ground planes are described, for example, in U.S. Pat. No. 4,588,667 to Jones et al. The entire disclosure of this patent is incorporated herein by reference. Although excellent toner images may be obtained with multilayered photoreceptors having a titanium ground plane, it has been found that charge deficient spots form in photoreceptors containing titanium ground planes, particularly under the high electrical fields employed in high speed electrophotographic copiers, duplicators and printers. Moreover, the growth rate in number and size of newly created charge deficient spots and growth rate in size of preexisting charge deficient spots for photoreceptors containing titanium ground planes are unpredictable from one batch to the next under what appear to be controlled, substantially identical fabrication conditions. Charge deficient spots are small unexposed areas on a photoreceptor that fail to retain an electrostatic charge. These charge deficient spots become visible to the naked eye after development with toner material. On copies prepared by depositing black toner material on white paper, the spots may be white or black depending upon whether a positive or reversal image development process is employed. In positive image development, charge deficient spots appear as white spots in the solid image areas of the final xerographic print. In other words, the image areas on the photoreceptor corresponding to the white spot fails to attract toner particles in positive right reading image development. In reversal image development, black spots appear in background areas of the final xerographic copy. Thus, for black spots to form, the charge deficient spots residing in background areas on the photoreceptor attract toner particles during reversal image development. The white spots and black spots always appear in the same location of the final electrophotographic copies during cycling of the photoreceptor. The white spots and black spots do not exhibit any single characteristic shape, are small in size, and are visible to the naked eye. Generally, these visible spots caused by charge deficient spots have an average size of less than about 200 micrometers. These spots grow in size and total number during xerographic cycling and become more objectionable with cycline. Thus, for example tiny spots that are barely visible to the naked eye can grow to a size of about 150 micrometers. Other spots may be as large as 150 micrometers with fresh photoreceptors. Visual examination of the areas on the surface of the photoreceptor which correspond to the location of white spots and black spots reveals no differences in appearance from other acceptable areas of the photoreceptor. There is no known test to detect a charge deficient spot other than by forming a toner image to detect the defect.

PRIOR ART STATEMENT

U.S. Pat. No. 4,461,819 to Nakagawa et al, issued July 24, 1984—Various electrophotographic imaging members are disclosed including one comprising, for example, a substrate, a ground plane layer comprising Al, Ag, Pb, Zn, Ni, Au, Cr, Mo, Ir, Nb, Ta, V, Ti, Pt and the like, and an amorphous silicon charge generating layer and a charge transport layer. A barrier layer is preferred to prevent injection of carriers from the substrate where the charge generating binder layer or the charge transport layer has a free surface that is charged. Representative barrier layers are $MgF_2$, $Al_2O_3$, SiO, $SiO_2$ and the like insulating inorganic compounds, polyethylene, polycarbonates, polyurethanes, poly-paraxylylene and the like insulating compounds, and Au, Ir, Pt, Rh, Pd, Mo and the like metals This electrophotographic imaging member is charged with a positive charge in most of the working examples. However, a negative charge is applied in Examples 8, 9, 14, 17, 18, 19, and 20.

Japanese Patent Publication No. J5 6024-356 to Fuji Photo Film KK, published Mar. 7, 1981—An electrophotographic photoreceptor is disclosed comprising a conductive support, an inorganic amorphous silicon photosensitive layer which produces a charge carrier by photo-irradiation, and a charge blocking layer between the conductive support and the inorganic amorphous silicon photosensitve layer, the charge blocking layer forming a barrier against electric charge carriers. The charge blocking layer comprises an insulating or semiconductive material such as $SiO_2$, $Al_2O_3$, $ZrO_2$, $TiO_2$ or an organic polymer such as polycarbonate, polyvinylbutyral, etc. These charge blocking layer materials are intended to block electrons into the inorganic amorphous silicon photosensitive layer.

U.S. Pat. No. 4,588,667 to R.N. Jones et al, issued May 13, 1986—An electrophotographic imaging member is disclosed comprising a substrate, a ground plane layer comprising a titanium metal layer contiguous to the substrate, a charge blocking layer contiguous to the titanium layer, a charge generating binder layer and a charge transport layer.

U.S. Pat. No. 4,439,507 to F. Y. Pan et al, issued Mar. 27, 1984—An electrophotographic imaging member is disclosed comprising a substrate, a conductive layer, a photogenerating layer comprising certain resinous material, and a charge transport layer comprising a resinous binder and an electrically active diamine material. The conductive layer includes, for example, aluminum, nickel, brass, gold titanium, stainless steel, chromium, graphite and the like. In an alternative embodiment, a dielectric layer may optionally be positioned between the photogenerating layer and the aluminum layer. The dielectric layer may include, for example, $Al_2O_3$, silicon oxides, silicon nitrides, titanates and the like.

U.S. Pat. No. 4,582,772 to L. A. Teuscher et al, issued Apr. 15, 1986—An electrophotographic imaging member is disclosed comprising a substrate, a transmissive semi-conductive layer selected from the group consisting of indium-tin oxide, cadmium tin oxide, tin oxide, titanium oxides, titanium nitrides, titanium silicides, and mixtures thereof, a photogenerating layer and a charge transport layer, comprising, for example, an electrically active diamine material.

U.S. Pat. No. 4,464,450 to L. A. Teuscher et al, issued Aug. 7, 1984—An electrophotographic imaging member is disclosed comprising a metal oxide layer, a siloxane film, a photogenerating layer and a charge transport layer, comprising, for example, an electrically active diamine material.

U.S. Pat. No. 4,587,189 to Ah-Mee Hor et al, issued May 6, 1986—An electrophotographic imaging member is disclosed comprising a semiconductive or conductive layer, a photogenerating layer comprising a perylene pigment, and an aryl amine hole transport layer.

Japanese Patent Publication No. 59-212844 to Kiyousera K. K., published Dec. 1, 1983—An electrophotographic sensitive body is disclosed comprising an aluminum substrate and an amorphous silicon layer having reduced amounts of Fe and/or Mn "To eliminate white spots lack of density and to enhance potential acceptance . . . ".

Many metals or other materials which are highly oxidatively stable, form a low energy injection barrier to the photoconductive material when utilized as a ground plane in a photoconductive device. A hole blocking layer will not form on these oxidatively stable layers thus rendering these devices non-functional as photoconductive devices. Other metals exhibit other deficiencies of one kind or another. Prior claims to good blocking layers refer to the average performance and do not take into account the fact that there localized areas of charge injection may be present. Thus, there is a continuing need for photoreceptors having ground planes that provide improved resistance to the formation and growth of charge deficient spots.

SUMMARY OF THE INVENTION

It is, therefore, an object of the present invention to provide an improved photoreceptor member which overcomes the above-noted disadvantages.

It is yet another object of the present invention to provide an improved electrophotographic member having a ground plane which exhibits greater resistance to the formation of charge deficient spots during cycling.

It is a further object of the present invention to provide a photoconductive imaging member which exhibits improved resistance to the growth in size of charge deficient spots during cycling.

It is still another object of the present invention to provide an electrophotographic imaging member which stabilizes or reduces during cycling the size and number of any charge deficient spots that may be present prior to cycling.

It is another object of the present invention to provide an electrophotographic imaging member which maintains optical transmission with cycling.

The foregoing objects and others are accomplished in accordance with this invention by providing an electrophotographic imaging member having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

A photoconductive imaging member of this invention may be prepared by providing a substrate in a vacuum, sputtering a layer of zirconium metal on the substrate in the absence of oxygen to deposit a continuous zirconium metal ground plane layer, exposing the zirconium metal ground plane layer to ambient conditions, applying a hole blocking layer on the zirconium metal layer, applying a charge generation binder layer on the blocking layer and applying a hole transfer layer on the charge generation layer. An adhesive layer may optionally be applied between the hole blocking layer and charge generation layer. The zirconium layer may be formed by any suitable coating technique, such as vacuum depositing technique. Typical vacuum depositing techniques include sputtering, magnetron sputtering, RF sputtering, and the like. Magnetron sputtering of zirconium onto a metallized substrate can be effected by a conventional type supttering module under vacuum conditions in an inert atmosphere such as argon, neon, or nitrogen using a high purity zirconium target. The vacuum conditions are not particularly critical. In general, a continuous zirconium film can be attained on a suitable substrate, e.g. a polyester web substrate such as Mylar available from E.I. du Pont de Nemours & Co. with magnetron sputtering. It should be understood that vacuum deposition conditions may all be varied in order to obtain the desired zirconium thickness. Typical RF sputtering systems such as a modified Materials Research Corporation Model 8620 Sputtering Module on a Welch 3102 Turbomolecular Pump is described in U.S. Pat. No. 3,926,762, the entire disclosure of which is incorporated herein in its entirety. This patent also describes sputtering a thin layer of trigonal selenium onto a substrate which may consist of titanium. Instead of sputtering a thin layer of trigonal selenium onto the titanium substrate, one may sputter a thin layer of zirconium onto the titanium substrate. Another technique for depositing zirconium by sputtering involves the use of planar magnetron cathodes in a vacuum chamber. A zirconium metal target plate may be placed on a planar magnetron cathode and the substrate to be coated can be transported over the zirconium target plate. The cathode and target plate are preferably horizontally positioned perpendicular to the path of substrate travel to ensure that the deposition of target material across the width of the substrate is of uniform thickness. If desired, a plurality of targets and planar magnetron cathodes may be employed to increase throughput, coverage or vary layer composition. Generally, the vacuum chamber is sealed and the ambient atmosphere is exacuated to about $5\times10^{-6}$ mm Hg. This step is immediately followed by flushing the entire chamber with argon at a partial pressure of about $1\times10^{-3}$ mm Hg to remove most residual wall gas impurities. An atmosphere of argon at about $1\times10^{-4}$ mm Hg is introduced into the vacuum chamber in the region of sputtering. Electrical power is then applied to the planar magnetron and translation of the substrate at approximately 3 to about 8 meters per minute is commenced.

If desired, an alloy of zirconium with a suitable metal such as niobium, tantalum, vanadium and hafnium, titanium, nickel, stainless steel, chromium, tungsten, molybdenum, and the like, and mixtures thereof may be substituted for the zirconium target to deposit a layer comprising a mixture of the evaporated metals. The target may be made of a pressed mixture of the metal powders where alloy combinations may be difficult to achieve. The selected combinations of metal powders are measured, weighed, and thoroughly mixed and compressed to form a sputtering target. The conductive layer may, in another embodiment of this invention, comprise a plurality of metal layers with the outermost metal layer (i.e. the layer closest to the generator layer) comprising at least 50 percent by weight of zirconium. At least 70 percent by weight of zirconium is preferred in the outermost metal layer for even better results. The multiple layers may, for example, all be vacuum deposited or a thin layer can be vacuum deposited over a thick layer prepared by a different techniques such as by casting. Typical metals that may be combined with zirconium include titanium, niobium, tantalum, vanadium, hafnium, and the like, and mixtures thereof. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Ground planes comprising zirconium tend to continuously oxidize during zerographic cycling due to anodizing caused by the passage of electric currents. Thus, it is preferred that a metal which oxidizes more slowly than zirconium during passage of an electric current is employed in the region of the conductive layer most remote from the photoconductive layer of a metal, particularly where the ground plane is thin and must remain transparent to electromagnetic radiation and be electrically conductive throughout extended xerographic cycling. Metals and/or alloys which oxidize more slowly than zirconium during passage of an electric current include, for example, titanium, nickel, gold, stainless steel, silver, brass, platinum, vanadium, nichrome, molybdenum, and the like. Generally, for rear erase exposure, a conductive layer light transparency of at least about 15 percent is desirable. The conductive layer need not be limited to metals. Other examples of conductive layers may be combinations of materials such as conductive idium tin oxide as a transparent layer for light having a wavelength between about 4000 Angstroms and about 7000 Anstroms or a conductive carbon black dispersed in a plastic binder as an opaque conductive layer.

Planar magnetrons are commercially availabe and are manufactured by companies such as the Industrial Vacuum Engineering Company, San Mateo, Calif., Leybold-Heraeus, Germany and U.S., and General Engineering, England. Magnetrons generally are operated at about 500 volts and 120 amps and cooled with water circulated at a rate sufficient to limit the water exit temperature to about 43° C. or less. The use of magnetron sputtering for depositing a metal layer on a substrate is described, for example, in U.S. Pat. No. 4,322,276 to Meckel et al, the disclosure of this patent being incorporated herein in its entirety.

If desired, the zirconium layer may be formed by other suitable techniques such as in situ on the outer surface of the substrate which may be a metal layer or layer of any other suitable material. Regardless of the technique employed to form the zirconium layer, a thin layer of zirconium oxide forms on the outer surface of the zirconium upon exposure to air. Thus, when other layers overlying the zirconium layer are characterized as "contiguous" layers, it is intended that these overlying contiguous layers may, in fact, contact a thin zirconium oxide layer that has formed on the outer surface of the zirconuium layer. If the zirconium layer is sufficiently thick to be self supporting, no additional underlying member is needed and the zirconium layer may function as both a substrate and a conductive ground plane layer. Generally, a zirconium layer thickness of at least about 100 angstroms is desirable to maintain optimum resistance to charge deficient spots during xerographic cycling. A typical electrical conductivity for conductive layers for electrophotgraphic imaging members in slow speed copiers is about $10^2$ to $10^3$ ohms/-square. A thickness of at least about 20 angstroms of zirconium on a conductive substrate is sufficient to provide resistance to growth of charge deficient spots.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate may be flexible or rigid and may have any number of many different configurations such as, for example, a plate, a cylindrical drum, a scroll, an endless flexible belt, and the like. Preferably, the substrate is in the form of an endless flexible belt and comprises a commercially available biaxially oriented polyester known as Mylar, available from E. I. du Pont de Nemours & Co. or Melinex available from ICI.

The thickness of the substrate layer depends on numerous factors, including economical considerations, and thus this layer for a flexible belt may be of substantial thickness, for example, over 200 micrometers, or of minimum thickness less than 50 micrometers, provided there are no adverse affects on the final photoconductive device. If the photoreceptor is a rigid metal drum, the substrate layer can be 5000 micrometers thick. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers. The surface of the substrate layer is preferably cleaned prior to coating to promote greater adhesion of the deposited coating. Cleaning may be effected by exposing the surface of the substrate layer to plasma discharge, ion bombardment and the like.

The conductive layer may vary in thickness over substantially wide ranges depending on the optical transparency desired for the electrophotoconductive member. Accordingly, the zirconium metal layer thickness can generally range in thickness of from at least about 20 angstroms units to many centimeters. When a flexible photoresponsive imaging device is desired, the thickness may be between about 20 angstrom units to about 750 angstrom units, and more preferably from about 50 Angstrom units to about 200 angstrom units for an optimum combination of electrical conductivity and light transmission.

After deposition of the zirconium metal layer, a hole blocking layer is applied thereto. The zirconium layer without the hole blocking layer results in low charge acceptance and the formation of white or black spots (depending on whether positive or reversal imaging is employed) which is different in appearance from the spots encountered with the combination of a titanium ground plane and a blocking layer. Thus a blocking layer is necessary in combination with the zirconium layer to achieve low dark decay, adequate charge acceptance and any significant reduction in black or white spots caused by charge deficient spots. Generally, electron blocking layers for positively charged photoreceptors allow holes from the imaging surface of the photoreceptor to migrate toward the conductive layer. Thus, an electron blocking layer is normally not expected to block holes in positively charged photoreceptors such as photoreceptors coated with charge generating layer and a hole transport layer. Any suitable hole blocking layer capable of forming an electronic barrier to holes between the adjacent photoconductive layer and the underlying zirconium layer may be utilized. The hole blocking layer may be organic or inorganic and may be deposited by any suitable technique. For example, if the hole blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo metallic salt. Other blocking layer materials include nitrogen containing siloxanes or nitrogen containing titanium compounds such as trimethoxysilyl propylene diamine, hydrolyzed trimethoxysilyl propyl ethylene diamine, N-beta(aminoethyl) gamma-aminopropyl trimethoxy silane, isopropyl 4-aminobenzene sulfonyl, di(dodecylbenzene sulfonyl) titanate, isopropyl di(4-aminobenzoyl) isostearoyl titanate, isopropyl tri(N-ethylaminoethylamino) titanate, isopropyl trianthranil titanate, isopropyl tri(N,N-dimethylethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl dieethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the zirconium oxide layer which inherently forms on the surface of the zirconium layer when exposed to air after deposition. This combination reduces spots at time 0 and provides electrical stability at low RH. The hydrolyzed silane has the general formula:

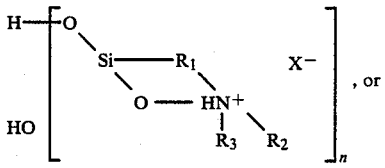

I

, or

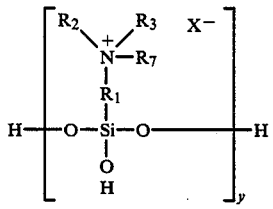

II or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1, 2, 3 or 4, and y is 1, 2, 3 or 4. The imaging member is prepared by depositing on the zirconium oxide layer of zirconium conductive anode layer a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The hydrolyzed silane may be prepared by hydrolyzing a silane having the following structural formula:

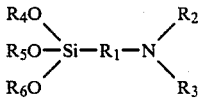

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which $R_1$ contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl group. As hydrolysis continues, the hydrolyzed silane takes on the following intermediate general structure:

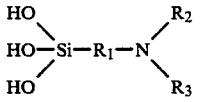

After drying, the siloxane reaction product film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 1.5 percent by weight of the silane based on the total weight of the solution. A solution containing from about 0.05 percent by weight to about 0.2 percent by weight silance based on the total weight of solution are preferred for stable solutions which form uniform reaction product layers. It is important that the pH of the solution of hydrolyzed silane be carefully controlled to obtain optimum electrical stability. A solution pH between about 4 and about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitble polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle. A brittle coating is, of course, not suitable for flexible photoreceptors, particularly in high speed, high volume copiers, duplicators and printers. The thicker coatings may, however, be acceptable in rigid photoreceptors.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation and cross-linking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si-O-wavelength bands between about 1,000 to about 1,200 $cm^{-1}$. If the Si-O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450 to L. A. Teuscher, the disclosure of this application being incorporated herein in its entirety.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms—3000 Angstroms) is preferred because charge neutralization after the exposure step is facilitated and optimum electrical performance is achieved. A thickness of between about 0.03 micrometer and about 0.06 micrometer is preferred for zirconium oxide layers for optimum electrical behavior and reduced charge deficient spot occurrence and growth. Optimum results are achieved with a siloxane blocking layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Generally, a weight ratio of blocking layer material and solvent of between about 0.05:100 and about 0.5:100 is satisfactory for spray coating.

In some cases, intermediate layers between the blocking layer and the adjacent generator layer may be desired to improve adhesion or to act as an electrical barrier layer. If such layers are utilized, they preferably have a dry thickness between about 0.04 micron to about 5 microns. Typical adhesive layers include film-forming polymers such as polyester, polyvinylbutyral, polyvinylpyrolidone, polyurethane, polycarbonates polymethylmethacrylate, mixtures thereof, and the like.

Any suitable photogenerating layer may be applied to the blocking layer or intermediate layer if one is employed, which can then be overcoated with a contiguous hole transport layer as described. Examples of photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, quinacidones available from DuPont under the tradename Monastral Red, Monastral violet and Monastral Red Y, Vat orange 1 and Vat orange 3 trade names for dibromo ant anthrone pigments, benzimidazole perylene, substituted 2,4-diamino-triazines disclosed in U.S. Pat. No. 3,442,781, polynuclear aromatic quinones available from Allied Chemical Corporation under the tradename indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multiphotogenerating layer compositions may be utilized where a photoconductive layer enhances or reduces the properties of the photogenerating layer. Examples of this type of configuration are described in U.S. Pat. No. 4,415,639, the entire disclosure of this patent beingincorporated herein by reference. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Numerous inactive resin materials may be employed in the photogenerating binder layer including those described, for example, in U.S. Pat. No. 3,121,006, the entire disclosure of which is incorporated herein by reference. Typical organic resinous binders include thermoplastic and thermosetting resins such s polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Thinner layers with higher pigment loadings are preferred. Higher binder content compositions generally require thicker layers for photogeneration. Thicknesses outside these ranges can be selected providing the objectives of the present invention are achieved.

The active charge transport layer may comprise any suitable transparent organic polymer of non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes of electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 angstroms to 8000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be transmitting in the wavelength region of use. The charge transport layer in conjunction with the generation layer in the instant invention is a material which is an insulator to the extent that an electrostatic charge placed on the transport layer is not conducted in the absence of illumination.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resion in which the aromatic amine is soluble.

The charge transport layer forming mixture preferably comprises an aromatic amine compound of one or more compounds having the general formula:

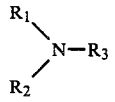

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

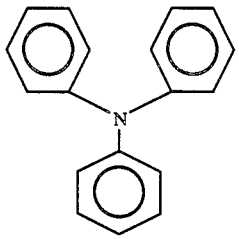

II. Bis and poly triarylamines such as:

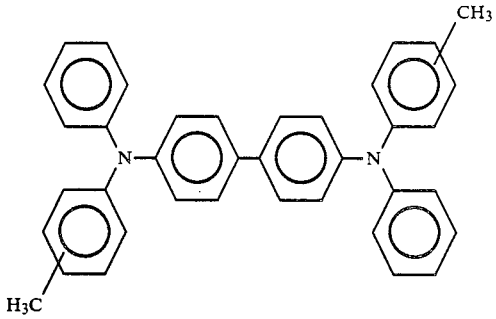

Bis arylamine ethers such as:

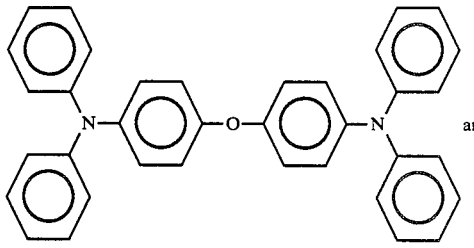

and

IV. Bis alkyl-arylamines such as:

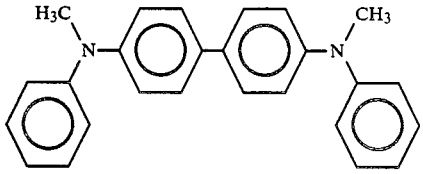

A preferred aromatic amine compound has the general formula:

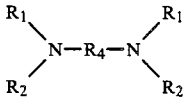

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4′-4″-bis(diethylamino)-2′,2″-dimethyltriphenylmethane, N,N′-bis(alkylphenyl)-[1,1′-biphenyl]-4,4′-diamine wherein the alkyl is, for example, methyl, ethyl, propyl, n-butyl, etc., N,N′-diphenyl-N,N′-bis(chlorophenyl)-[1,1′-biphenyl]-4,4′-diamine, N,N′-diphenyl-N,N′-bis(3″-methylphenyl)-(1,1′-biphenyl)-4,4′-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonated resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

An especially preferred multilayered photoconductor comprises a charge generation layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

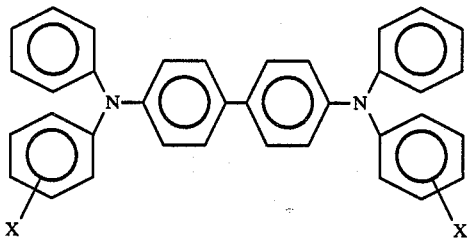

wherein X is selected from the group consisting of an alkyl group, having from 1 to about 4 carbon atoms and chlorine, the photoconductive layer exhibiting the capability of photogeneration of holes and injection of the holes and the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

Any suitable and conventional technique may be utilized to mix and thereafter apply the charge transport layer coating mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between bout 5 micrometers to about 100 micrometers, but thicknesses outside this range can also be used.

Generally, the thickness of the hole transport layer is between about 5 to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

If desired, any suitable single photoconductive layer capable of accepting a negative charge may be substituted for the combination of two electrically active layer described above. Typical single photoconductive layers include photoconductive particles such as zinc oxide, amorphous selenium, cadmium sulphide, vanadyl phthalocyanine, cadmium telluride, cadmium selenide, solid solutions thereof, and the like dispersed in an inactive film forming polymeric binder.

Any suitable inactive film forming polymeric binder may be employed in the single photoconductive layer capable of accepting a negative charge. Typical organic film forming polymeric binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers. The photoconductive composition or pigment is present in the resinous binder composition of the single photoconductive layer in various amounts, generally, however, from about 5 percent by volume to about 90 percent by volume of the photoconductive pigment is dispersed in about 95 percent by volume to about 10 percent by volume of the resinous binder, and preferably from about 10 percent by volume to about 30 percent by volume of the photoconductive pigment is dispersed in about 90 percent by volume to about 70 percent by volume of the resinous binder composition. In one embodiment about 25 percent by volume of the photoconductive pigment is dispersed in about 75 percent by volume of the resinous binder composition. The single photoconductive layer capable of accepting a negative charge generally ranges in thickness of from about 10 micrometer to about 40 micrometers, and preferably has a thickness of from about 20 micrometer to about 30 micrometers. Thicknesses outside these ranges can be selected providing the objectives of the present invention are achieved. Typical single photoconductive layers are described, for example, in U.S. Pat. No. 3,121,006, the entire disclosure of which is incorporated herein by reference.

Other layers such as conventional ground strips comprising, for example, conductive particles disposed in a film forming binder may be applied to one edge of the photoreceptor in contact with the zirconium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

BRIEF DESCRIPTION OF THE DRAWINGS

A more complete understanding of the process and device of the present invention can be obtained by reference to the accompanying drawings wherein.

DETAILED DESCRIPTION OF THE DRAWINGS

Figure 1:
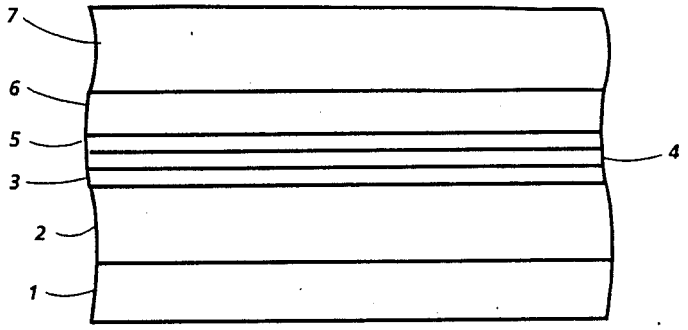
FIG. 1 is a schematic illustration of a prior art photoreceptor having a single metal ground plane.
Figure 2:
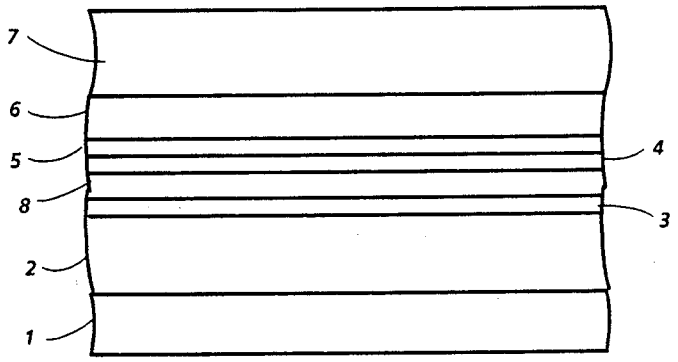
FIG. 2 is a schematic illustration of one embodiment of a photoreceptor of this invention having a plurality of ground planes.
Figure 3:
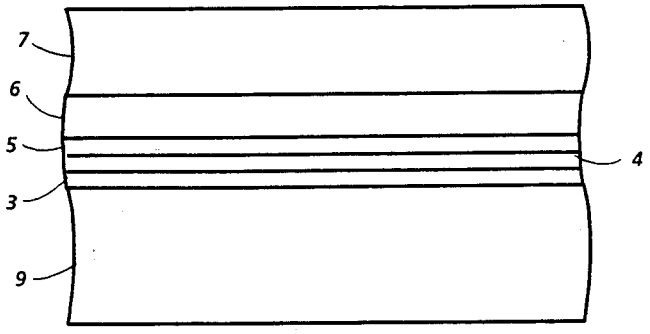
FIG. 3 is a schematic illustration of another embodiment of a photoreceptor of this invention having a plurality of ground planes.

In the drawings, FIGS. 1–3 represents several types of photoreceptor plates. They are basically similar and contain many layers that are common to the other photoreceptors.

Referring to FIG. 1, a prior art photoreceptor is shown having an anticurl backing coating 1, a supporting substrate 2, a metal ground plane 3, a blocking layer 4, an adhesive layer 5, a charge generator layer 6, and a charge transport layer 7.

In FIG. 2, a photoreceptor of this invention is illustrated. This photoreceptor differs from the photoreceptor shown in FIG. 1 in that an additional ground plane 8 is employed comprising zirconium.

With reference to FIG. 3, a photoreceptor of this invention is shown. This photoreceptor differs from the photoreceptor shown in FIG. 2 in that a thick rigid metal substrate 9 is employed rather than the anticurl backing coating 1, supporting substrate 2 and metal ground plane 3.

Figure 4:
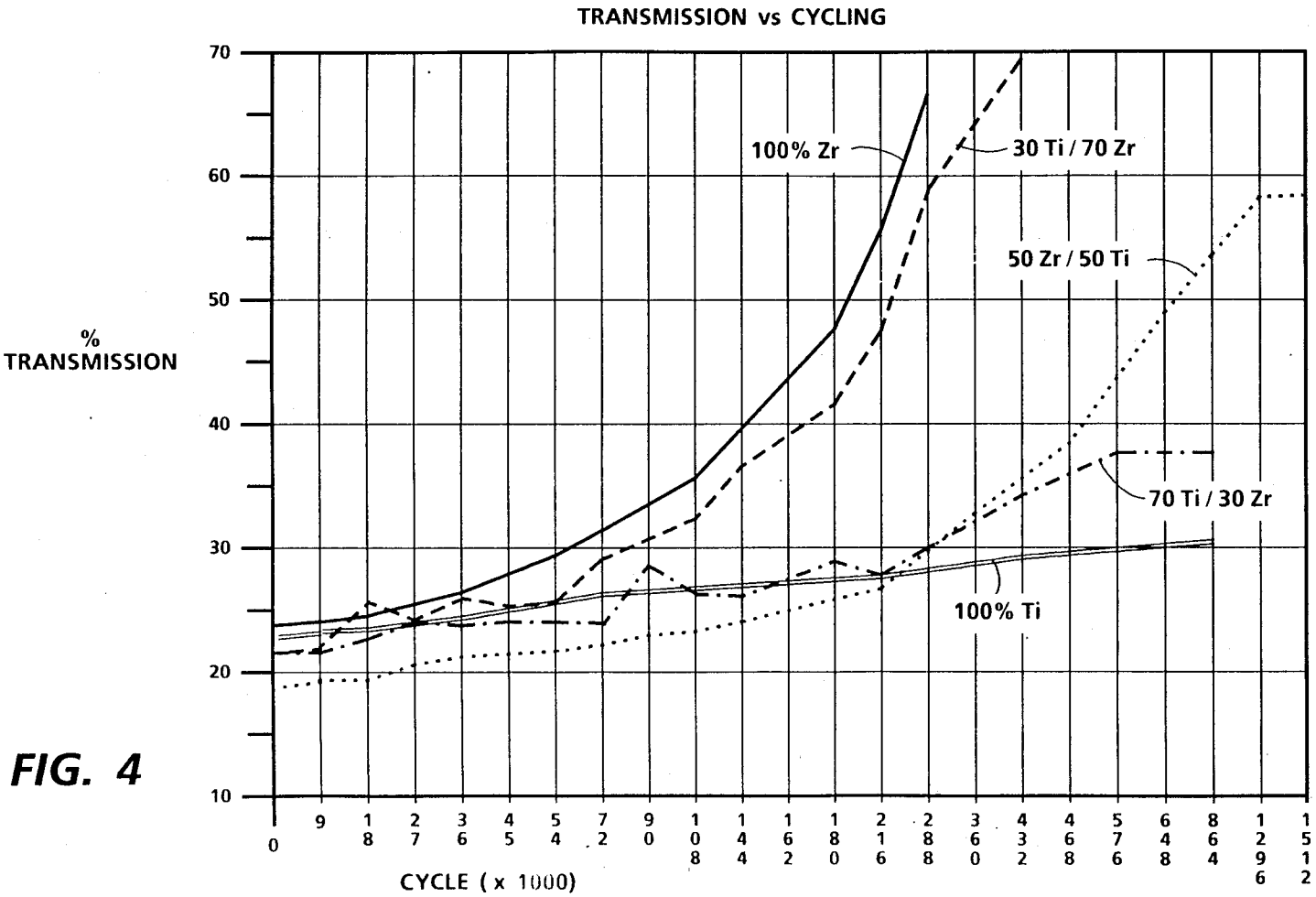
FIG. 4 graphically compares the light transmission characteristics of various ground planes during cycling.

In FIG. 4, the light transmission characteristics of various ground planes during cycling are compared under conditions described in Example IX.

Figure 5:
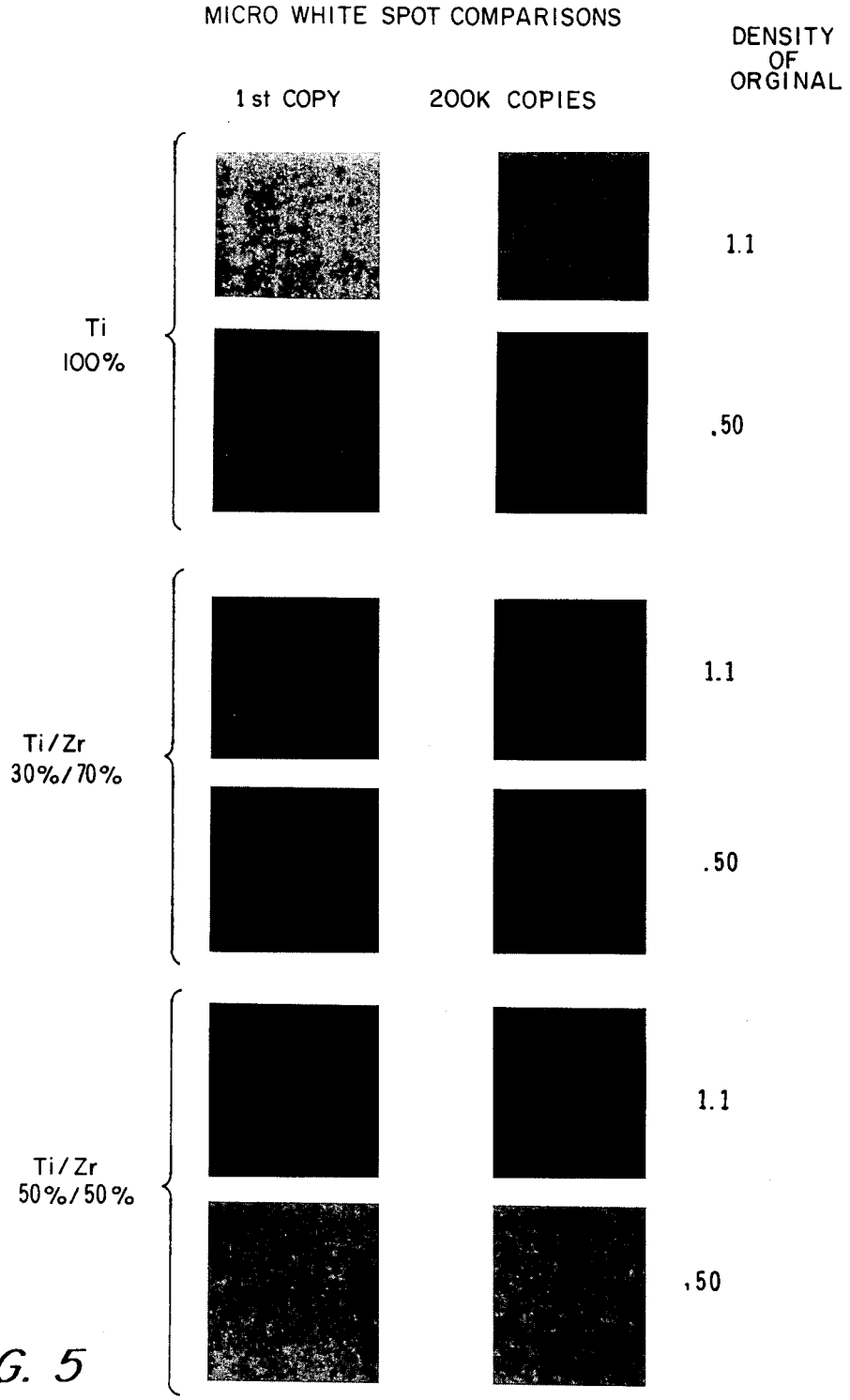
FIG. 5 is a plurality of photographs of xerographic copies made from originals of different densities on xerographic photoreceptors comprising various ground plane materials.

Referring to FIG. 5, print tests were performed at the start and end of cycling tests using normal xerographic development with photoreceptors having different ground planes. White spots in the solid image area of copies of originals having a density of 1.1 and 0.5 were counted and compared. Details of the procedures and results are described in Example IX.

The electrophotographic member of the present invention may be employed in any suitable and conventional electrophotographic imaging process which utilizes negative charging prior to imagewise exposure to activating electromagnetic radiation. When the imaging surface of an electrophotographic member is uniformly charged with a negative charge and imagewise exposed to activating electromagnetic radiation. Conventional positive or reversal development techniques may be employed to form a making material image on the imaging surface of the electrophotographic imaging member of this invention. Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, positively charged toner particles are attracted to the negatively charged electrostatic areas of the imaging surface and for reversal development, negatively charged toner particles are attracted to the discharged areas of the imaging surface.

The electrophotographic member of the present invention exhibits fewer or no charge deficient spots prior to cycling, greater resistance to the formation of charge deficient spots during cycling, and improved resistance to the growth in size of charge deficient spots during cycling. The improvement relating to charge deficient spots provided by the electrophotographic imaging members of this invention is orders of magnitude greater that of photoreceptors utilizing a titanium ground plane. Photoreceptors with aluminum or titanium ground planes exhibit a increase in the number and size of charge deficient spots. Surprisingly, the electrophotographic member of present invention reduces during cycling the size and number of any charge deficient spots that might be present prior to cycling. Thus, any charge of deficient spots initially present in electrophotographic members having a zirconium ground plane appear to heal and disappear with cycling.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the aluminum layer with a gravure applicator. The deposited coating was dried at 135° C. in a forced air oven to form a layer having a thickness of 120 Angstroms. A coating of polyester resin, Goodyear PE100 (available from the Goodyear Tire an Rubber Co.) was applied with a gravure applicator to the siloxane coated base. The polyester resin coating was dried to form a film having a thickness of about 0.05 micrometer. A slurry coating solution of 3 percent by weight sodium doped tirgonal selenium having a particle size of about 0.05 micrometer to 0.2 micrometer and about 6.8 percent by weight polyvinylcarbazole and 2.4 percent by weight N,N'-diphenyl-N,N'-bis(3 methyl phenyl)-[1,1'-biphenyl]-4,4' diamine in a 1:1 by volume mixture of tetrahydrofuran and toluene was extrusion coated onto the polyester coating to form a layer having a wet thickness of 26 micrometers. The coated member was dried at 135° C. in a forced air oven to form a layer having a thickness of 2.5 micrometers. A charge transport layer was formed on this charge generator layer by applying a mixture of a 60–40 by weight solution of Makrolon, a polycarbonate resin having a molecular weight from about 50,000 to about 100,000 available from Farbenfabriken Bayer A. G., and N,N'-diphenyl-N,N'-bis(3-methylphenyl)-[1,1'-biphenyl]-4,4'-diamine dissolved in methylene chloride to give a 15 percent by weight solution. The components were extrusion coated on top of the generator layer and dried at temperature of about 135° C. to form a 24 micrometer thick dry layer of hole transporting material. A grounding strip coating and an anti curl backing coating were also applied. This photoreceptor was then cut and welded to form a continuous belt. The photoreceptor was then mounted in a Xerox 1065 machine for testing. The Xerox 1065 machine is a xerographic device which drives the photoreceptor belt at a constant speed of 11.25 inches per second. Charging devices, exposure lights, magnetic brush developer applicator and erase lights and probes are mounted around the periphery of the mounted photoreceptor belt. The photoreceptor was rested in the dark for 60 minutes prior to charging. It was then negatively corona charged in the dark to a development potential of −750 v. The photoreceptor was thereafter imagewise exposed to a test pattern using a light intensity of about 5 erg/cm$^2$ of light. The resulting negatively charged electrostatic latent image was developed with positively charged toner particles applied by a magnetic brush applicator. After electrostatic transfer of the deposited toner image to a paper copy sheet, the photoreceptor was discharged (erased) by exposure to about 500 erg/cm$^2$ of light. The toner images transferred to the copy sheets were fused by heated roll fusing. The photoreceptor was then subjected to the equivalent life of 200,000 imaging cycles. After initial copies were made at ambient room conditions (about 35 percent RH and 70° F.), the machine was then subjected to stress environmental conditions (10 percent RH, 70° F.). The machine was cycled without feeding paper. At the end of the test, the machine was returned to ambient room conditions. Paper was fed into the machine for imaging. The toner image areas of the imaged copy sheets were examined with a 7× magnifying loupe for white spots. The area examined was a solid block rectangle (1.4 inches×2.5 inches) with a 1.1 density value. The number of white spots were circled and tabulated. The copy sheet from the first imaging cycle had 1 white spot and the copy sheet from the last imaging cycle had 75 white spots. These findings were used to determine growth rate per 100,000 imaging cycles by dividing (75 white spots—1 white spot) by 2. Thus, the growth rate was +37 white spots per 100,000 imaging cycles.

EXAMPLE II

The procedures of Example I were repeated with the same materials except that instead of being vacuum coated with a titanium layer, the polyester film was coated by sputtering in a vacuum in the absence of oxygen a zirconium metal layer having a thickness of about 200 Angstroms. Utilizing the testing procedures of Example I, the photoreceptor was subjected to 200,000 imaging cycles. The toner image areas (1.4 inches×2.5 inches and 1.1 density) of the imaged copy sheets were examined for white spots with a 7× magnifying loupe. The copy sheet from the first imaging cycle had 25 white spots and the copy sheet from the last imaging cycle had 8 white spots. This was a growth rate of −9 white spots 100,000 imaging cycles with the zirconium metal layer of this invention.

EXAMPLE III

The procedures of Example I were repeated with the same materials except that instead of being vacuum coated only with a single titanium layer, the polyester film was coated by sputtering in a vacuum in the absence of oxygen a titanium metal layer having a thickness of about 65 Angstroms. Without breaking the vacuum, the titanium layer was coated by sputtering, in the absence of oxygen, a zirconium metal layer having a thickness of about 125 Angstroms. The exposed surface of the zirconium layer was oxidized by exposure to oxygen in the ambient atmosphere at elevated temperatures. Utilizing the testing procedures and conditions of Example I, the photoreceptor was subjected to 200,000 imaging cycles. The toner image areas of the imaged copy sheets were examined for white spots with a 7× magnifying loupe. The copy sheet from the first imaging cycle had 10 white spots and the copy sheet from the last imaging cycle had 35 white spots. This was a growth rate of +13 white spots per 100,000 imaging cycles.

EXAMPLE IV

The procedures for preparing the photoreceptor belts in Example I were repeated except that the following materials were changed. The interface layer was a coating of polyester (duPont 49,000, available from E. I. duPont de Nemours & Co.) It was applied with a gravure applicator to the siloxane coated base. The polyester resin coating was dried to form a film having a thickness of about 0.05 micrometer. The same charge generator layer was applied as in Example I. The charge transport layers were the same materials as Example I. However, the ratios were 50-50 by weight solution of polycarbonate resin (Makrolon, available from Farbenfabrikan Bayer A. G.) and N,N'-diphenyl-N,N'-bis(3-methyl phenyl-[1,1'-biphenyl]-4,4'-diamine dissolved in methylene choride. All other materials and processes were the same as Example I.

The photoreceptor was welded into a continuous belt and mounted on a Xerox 1075 duplicator used as a test fixture which drives the belt at a constant rate of 11.3 inches per second. The Xerox 1075 duplicator contained charging devices, exposure lights, magnetic brush developer applicator, and erase lights and probes mounted around the periphery of the mounted photoreceptor belt.

The photoreceptor was rested in the dark for 15 minutes prior to charging. It was then negatively corona charged in the dark to a development potential of −800 volts. The resulting charge photoreceptors were developed with a reversal toner. Reversal toners form deposits in the discharged areas on the photoreceptor corresponding to the white areas on the copy paper. To accomplish reversal development, a bias voltage of 600 volts was applied to the developer applicator rolls. With reversal development, the charge deficient spots print out as black spots in the charged background areas on the copy paper. In this test sequence, the photoreceptor was continuously charged and developed with no light exposure. The test was accomplished at 20 percent RH. The resulting negatively charged electrostatic latent image was developed with negatively charged toner particles applied by the magnetic brush applicator. After electrostatic transfer of the deposited toner from charge deficient areas, the photoreceptor was recharged to maintain a development potential of 800 uniformly over the imaging surface.

In this test, the photoreceptor was cycled continuously for 1 hour. A one square inch area was examined to measure the spot count. The titanium ground plane photoreceptors had an average of 68 spots per square inch. After one hour of cycling, the titanium ground plane photoreceptors had an average of 225 spots per square inch. This was a growth rate of +157 white spots per hour of cycling.

EXAMPLE V

The procedures employed in Example IV were repeated except that instead of being vacuum coated with a titanium layer, the polyester film was coated by sputtering in a vacuum in the absence of oxygen a zirconium layer having a thickness of about 200 Angstroms. Utilizing the test procedures described in Example IV, the photoreceptor was cycled for 1 hour. The copy sheet was examined for black spots in the same manner as described in Example IV. The copy sheet from the first cycle had 58 spots per square inch and the copy sheet after 1 hour of cycling had 89 spots per square inch. This was a growth rate of only +31 white spots per hour of cycling with the zirconium layer of this invention.

EXAMPLE VI

The procedures for preparing the photoreceptor belts in Example I were repeated except that the following materials were changed. The binder generator layer was a slurry coating solution of 0.5 percent by weight vanadyl phthalocyanine having a particle size of about 0.2 micrometer and about 4.5 percent by weight polycarbonate resin having a molecular weight of about 50,000 to about 100,000 (Makrolon, available from Farbenfabriken Bayer, A. G.) dissolved in methylene chloride to give a 5.0 precent by weights solids solution.

The resulting photoreceptor was cut and welded to form a continuous belt. The photoreceptor was then mounted in a laboratory xerographic device which drove the photoreceptor belt at a constant speed of 6.8 inches per second. Charging devices, exposure lights, magnetic brush developer applicator, erase lights and probes were mounted around the periphery of the mounted photoreceptor belt. The photoreceptor was rested in the dark for 60 minutes prior to charging. It was then negatively corona charged in the dark to a development potential of −750 v. The photoreceptor was thereafter imagewise exposed to a test pattern using a light intensity of about 10 erg/cm$^2$ of light. THe resulting negatively charged electrostatic latent image was developed with positively charged toner particles applied by a magnetic brush applicator. After electrostatic transfer of the deposited toner image to a paper copy sheet, the photoreceptor was discharged (erased) by exposure to about 500 erg/cm$^2$ of light. The toner images transferred to the copy sheets were fused by heated roll fusing. The machine was then run for 20,000 copies. All of the copies were prepared at an ambient room condition of 35 percent RH and 70° F. The toner image areas of the imaged copy sheets were examined with a 7× magnifying loupe for total number of white spots. The area examined was a solid square block (0.5 inch×0.5 inch) with a 1.1 density value. The copy sheet from the first imaging cycle had 176 white spots and the copy sheet from the last imaging cycle had 212 white spots. The growth rate per 100,000 imaging cycles for this 0.25 square inche solid area block was determined by multiplying (212 white spots—176 white spots) by 5. Thus, the growth rate was +160 white spots per 100,000 imaging cycles. cl EXAMPLE VII The procedures of Example VI were repeated with the same materials except that instead of being vacuum coated with a titanium layer, the polyester film was coated by sputtering in a vacuum in the absence of oxygen a zirconium metal layer having a thickness of about 200 Angstroms. Utilizing the testing procedures of Example VI, the photoreceptor was subjected to 20,000 imaging cycles. The toner image areas (0.5 inch×0.5 inch and 1.1 density) of the imaged copy sheets were examined for white spots with a 7× magnifying loupe. The copy sheet from the first imaging cycle had 10 white spots and the copy sheet from the last imaging cycle had 5 white spots. This was a growth rate of −25 white spots per 100,000 imaging cycles with the zirconium metal layer of this invention.

EXAMPLE VIII

The procedures employed in Example IV were repeated except that instead of being vacuum coated with a titanium layer, the polyester film was coated by sputtering in a vacuum in the absence of oxygen a zirconium layer having a thickness of about 200 Angstroms. The silane blocking layer was omitted. All the remaining photoreceptor layers were coated as in Example IV. Utilizing the test procedures described in Example IV, the photoreceptor was cycled for 1 hour. The copy sheet was examined for black spots in the same manner as described in Example IV. The copy sheet from the first cycle had 3,629 spots per square inch and the copy sheet after 1 hour of cycling had 2,925 spots per square inch. This test shows that a zirconium ground plane without the silane blocking layer is a poor, non-uniform blocking layer having many localized areas of charge injection. The spot count is two orders of magnitude higher without a blocking layer.

EXAMPLE IX

Sandwich structures having nominal 20 percent light transmission were prepared using pure Titanium, 30/70 volume ratio Zirconium/Titanium, 50/50 volume ratio Zirconium/Titanium, 70/30 volume ratio Zirconium/-Titanium, and pure Zirconium. The metals were applied to a transparent substrate with separate magnetron sputtering stations with the titanium deposited first and the zirconium deposited on top. Metal thicknesses were adjusted to obtain the 20% optical transmission with the Titanium to Zirconium ratios described above. Photoreceptors were made from these five combinations of substrates and ground planes by depositing coatings of a siloxane blocking layer, a polyester adhesive layer (PE-100, available from Goodyear Tire and Rubber Co.), a charge generating layer of trigonal selenium particles dispersed in a binder, and a polycarbonate resin and N,N'-diphenyl-N,N'-bis(3-methylphenyl)-[1,1'-biphenyl]-4,4'-diamine transport layer as described in Example I. Substrate oxidation rates were determined by placing circular dot shaped graphite paint conductive electrodes having a one square centimeter contact area on top of a portion of the photoreceptor. A constant current of one microamp was passed through these electrodes on the photoreceptor using a Trek 610a COR-A-TROL device. After a given number of cycles, one dot shaped electrode was removed. After another 9,000 cycles, another electrode was removed and so on for the cycle periods shown in the table below. The active organic layers of the photoreceptor under the dot shaped electrodes were removed by washing with methylene chloride and the transmission of the substrate under each dot shaped electrode was measured. A graph of transmission versus integrated current (charge) was then prepared to determine the change in substrate properties as a function of xerographic cycles. The conversion of charge to xerographic cycles was accomplished by dividing the total amount of charge passed through the sample by the amount of charge required for one xerographic cycle. For a photoreceptor with capacitance C per square centimenter charged to an initial potential V the charge per square centimeter Q is determined by $Q=CV$. In the test samples, the charge per square centimeter for one cycle was developed from a capacitance of 100 picofarads per square centimeter and an initial potential of 1,000 volts. The total amount of charge passed through the sample was divided by the amount of charge required for one xerographic cycle to determine an equivalent photoreceptor cycle. The results of the constant current cycling simulation are presented in the following Table and in FIG. 4.

TRANSMISSION vs CYCLING OF GROUND PLANES

| Cycle | 100% ZR | 30 Ti/ 70 ZR | 50 ZR/ 50 Ti | 100% Ti | 70 Ti/ 30 ZR |
|---|---|---|---|---|---|
| 0 | 23.7 | 21.7 | 18.7 | 22.6 | 21.7 |
| 9000 | 24.0 | 21.9 | 19.4 | 23.0 | 22.3 |
| 18000 | 24.8 | 23.5 | 19.6 | 23.4 | 22.9 |
| 27000 | 25.6 | 24.3 | 20.6 | | 24.3 |
| 36000 | 26.8 | 25.9 | 21.0 | 24.8 | 23.9 |
| 45000 | | 25.1 | | | 24.1 |
| 54000 | 28.7 | 25.7 | 21.6 | | 24.1 |
| 72000 | 31.1 | 28.4 | 22.2 | 26.1 | 23.9 |
| 90000 | | | 23.0 | | 28.1 |
| 108000 | 35.5 | 32.4 | 23.4 | | 26.7 |
| 144000 | | 36.7 | 24.0 | | 26.5 |
| 162000 | | | | | |
| 180000 | 47.2 | 41.3 | | | 28.9 |
| 216000 | 56.1 | 47.3 | 26.4 | 27.1 | 27.5 |
| 288000 | 66.4 | 59.2 | | | 30.0 |
| 360000 | | | 33.3 | | |
| 432000 | | 69.3 | | 29.1 | 34.4 |
| 468000 | | | 38.1 | | |
| 576000 | | | | | 37.3 |
| 648000 | | | 48.6 | | |
| 864000 | | | 53.0 | 30.1 | 37.3 |
| 1296000 | | | 57.9 | | |
| 1512000 | | | 58.1 | | |

As shown in the Table above and in FIG. 4, pure zirconium layer initially exhibits about 24 percent light transmission capability and is entirely oxidized and more transparent after 280,000 cycles. The device with a pure titanium layer has changed in transmission characteristics from 20 percent to 26 percent over the same cycling interval. The multiple metal layer structures have an intermediate oxidation rate determined by the amount of titanium present.

Photoreceptors were also made with fresh substrates identical to the substrates described above in this Example and tested for the equivalent of 200,000 cycles in a Xerox 1065 copier. Print tests were performed at the start and end of the test using normal xerographic development. White spots in a solid image area of a copy of an original having a density of 1.1 were counted and a density per square inch determined.

| | WHITE SPOTS | | | |
|---|---|---|---|---|
| Sample | Spots at Start | Spots at End | Growth Rate Per 100,000 Cycles | FIG. 5 Row of Photos From Top |
| Pure Ti | 1 | 75 | +37 | 1st Row |
| Pure Zr | 25 | 8 | −9 | |
| Ti/Zr 30/70 | 4 | 1 | −2 | 3rd Row |
| Ti/Zr 50/50 | 40 | 5 | −18 | 5th Row |
| Ti/Zr 70/30 | 5 | 120 | +58 | |

The pure titanium and the multiple metal layer sandwich structures containing only a small amount of zirconium showed a significant increase in Charge Deficient Spots with a minimum increase in optical transmission while the pure zirconium sample showed a reduction in the level of Charge Deficient Spots with a rapid change in transmission. The samples with 50 percent and 70 percent Zirconium content showed a decrease in charge Deficient Spot level and reasonable transmission change with cycling. A comparison of white spots on copies of an original having a density of 0.5 are illustrated in the photographs located in the second, fourth and sixth rows of FIG. 5. Thus, for copies of originals having a range of densities such as photographic originals, many more white spots are encountered with photoreceptors having a titanium ground plane of 100 percent titanium.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member having an imaging surface adapted to accept a negative electrical charge, said electrophotographic imaging member comprising a metal ground plane layer comprising at least 50 percent by weight zirconium, a hole blocking layer, a charge generation layer comprising photoconductive particles dispersed in a film forming resin binder, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

2. An electrophotographic imaging member according to claim 1 wherein the combination of said metal ground plane layer and said blocking layer transmits at least 15 percent of light having a wavelength between about 4000 Angstroms and about 7000 Angstroms.

3. An electrophotographic imaging member according to claim 1 wherein said metal ground plane layer comprises a zirconium layer overlying a titanium layer.

4. An electrophotographic imaging member according to claim 3 wherein said zirconium layer has a thickness of at least about 20 Angstrom units.

5. An electrophotographic imaging member according to claim 1 wherein said blocking layer comprises a siloxane, said siloxane comprising a reaction product of a hydrolyzed silane having the structural formula

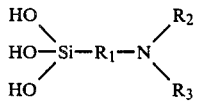

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group.

6. An electrophotographic imaging member according to claim 5 wherein said blocking layer comprising said siloxane has a thickness of between about 0.03 micrometer and about 0.06 micrometer.

7. An electrophotographic imaging member according to claim 1 wherein said charge generating binder layer comprises particles or layers comprising a photoconductive material selected from the group consisting of vanadyl phthalocyanine, metal free phthalocyanine, benzimidazole perylene, trigonal selenium, selenium alloys selected from the group consisting of selenium-tellurium, selenium-tellurium-arsenic, selenium arsenide, and mixtures thereof.

8. An electrophotographic imaging member according to claim 1 wherein said hole transport layer comprises an organic polymer and an aromatic amine compound having the general formula:

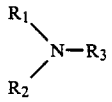

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

9. An electrophotographic imaging member according to claim 8 wherein said hole transport layer comprises a polycarbonate resin material having a molecular weight of from about 20,000 to about 120,000 and from about 25 to about 75 percent by weight of said diamine compound based on the total weight of said polycarbonate resin.

10. A flexible electrophotographic imaging member having an imaging surface adapted to accept a negative electric charge, said comprising a substrate, a metal base layer, a thin overcoating metal layer comprising at least 50 percent by weight of zirconium contiguous to said metal base layer, a hole blocking layer comprising a siloxane contiguous to said thin overcoating metal layer, said siloxane comprising a reaction product of a hydrolyzed silane having the structural formula

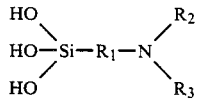

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group, a charge generation layer comprising photoconductive particles dispersed in a film forming resin binder, and a hole transport layer comprising a resin binder and a diamine compound.

11. An electrophotographic imaging member according to claim 10 wherein said thin overcoating metal layer comprising zirconium comprises a mixture of 50 percent by volume zirconium and 50 percent by volume another metal.

12. An electrophotographic imaging member according to claim 10 including a layer of an adhesive material interposed between said blocking layer and said charge generation layer.

13. An electrophotographic imaging member according to claim 10 wherein said charge generation layer comprises particles of trigonal selenium.

14. An electrophotographic imaging member according to claim 10 wherein said charge generating layer comprises particles selected from the group consisting of vanadyl phthalocyanine and metal free phthalocyanine.

15. An electrophotographic imaging member according to claim 10 wherein said charge generating layer comprises particles of benzimidazoleperylene.

16. An electrophotographic imaging member according to claim 10 wherein said charge generation layer comprises an evaporated layer of benzimidazole perylene.

17. An electrophotographic imaging member according to claim 10 wherein said charge generation layer is contiguous to a layer comprising a solid solution of a polycarbonate resin material and said diamine compound, said diamine compound being selected from the group consisting of one or more compounds having the general formula:

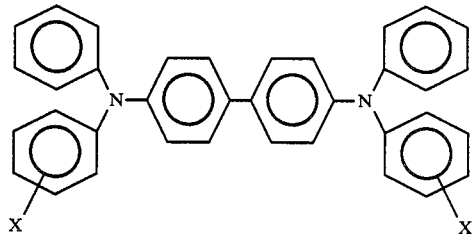

wherein X is selected from the group consisting of an alkyl group having from 1 to about 4 carbon atoms and chlorine.

18. An electrophotographic imaging member comprising a substrate, a metal base layer, a zirconium metal layer comprising at least 50 percent by weight of zirconium, a blocking layer comprising a siloxane contiguous to said zirconium metal layer, said metal base layer comprising a metal which oxidizes more slowly than zirconium during passage of an electric current, said siloxane comprising a reaction product of a hydrolyzed silane having the general formula

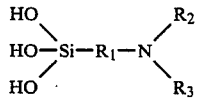

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group, an adhesive layer comprising a film forming polymer, a charge generation layer comprising photoconductive particles dispersed in a film forming binder, and a hole transport layer comprising a solid solution of a polycarbonate resin material and a diamine compound, said diamine compound having the general formula:

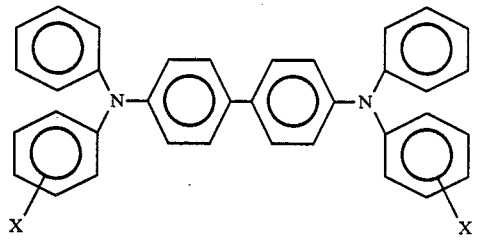

wherein X is selected from the group consisting of an alkyl group having from 1 to about 4 cabon atoms and chlorine.

19. An electrophotographic imaging member according to claim 18 comprising a substrate, a titanium metal base layer, and a zirconium metal layer.

20. An electrophotographic imaging member according to claim 18 wherein said charge generation layer has a thicknes between about 0.1 micrometer and about 5 micrometers and wherein said generation layer comprises between about 5 percent and about 90 percent by volume of said photoconductive particles.

21. An electrophotographic imaging member according to claim 18 wherein said hole transport layer has a thickness between about 10 micrometers and about 40 micrometers.

* * * * *